US008776814B1

(12) United States Patent
Beam et al.

(10) Patent No.: US 8,776,814 B1
(45) Date of Patent: Jul. 15, 2014

(54) WINDOW ADJUSTMENT SYSTEM FOR BLINDS

(75) Inventors: Keith Beam, New Glarus, WI (US); Scott D. Lee, Madison, MS (US)

(73) Assignee: Primos, Inc., Flora, MS (US)

( * ) Notice: Subject to any disclaimer, the term of this patent is extended or adjusted under 35 U.S.C. 154(b) by 0 days.

(21) Appl. No.: 13/207,296

(22) Filed: Aug. 10, 2011

(51) Int. Cl.
*E04H 15/58* (2006.01)
*E04H 15/54* (2006.01)

(52) U.S. Cl.
USPC ..... 135/117; 135/115

(58) Field of Classification Search
USPC ..... 135/117, 91, 93, 115; 160/181, 201, 160/84.03, 84.06
See application file for complete search history.

(56) References Cited

U.S. PATENT DOCUMENTS

| | | | | | |
|---|---|---|---|---|---|
| 574,091 | A | | 12/1896 | Irvine, Jr. | |
| 851,141 | A | | 4/1907 | Stempel | |
| 1,079,757 | A | | 11/1913 | Gould | |
| 1,376,218 | A | | 4/1921 | Morant | |
| 1,572,939 | A | * | 2/1926 | Leffert | 135/117 |
| 1,583,832 | A | * | 5/1926 | Hoigaard | 135/117 |
| 1,648,311 | A | * | 11/1927 | Johnson | 160/239 |
| 1,854,671 | A | | 4/1932 | Roberts | |
| 1,888,014 | A | * | 11/1932 | Powers | 135/117 |
| 2,118,474 | A | * | 5/1938 | Morton | 135/93 |
| 2,666,441 | A | * | 1/1954 | Powers | 135/117 |
| 2,803,298 | A | | 8/1957 | Schlesinger | |
| 3,073,326 | A | * | 1/1963 | Lefebvre et al. | 135/88.14 |
| 3,255,809 | A | | 6/1966 | Kawczynski | |
| 3,545,461 | A | * | 12/1970 | Carlson | 135/90 |
| 4,437,505 | A | | 3/1984 | Rodgers | |
| 4,473,087 | A | | 9/1984 | Cavender | |
| 5,010,909 | A | | 4/1991 | Cleveland | |
| 5,193,602 | A | | 3/1993 | Morales | |
| 5,762,085 | A | | 6/1998 | Punch | |
| 5,765,584 | A | | 6/1998 | Heisler et al. | |
| 5,819,474 | A | * | 10/1998 | Strom | 52/4 |
| 5,918,615 | A | * | 7/1999 | Stuck, Sr. | 135/135 |
| 6,021,794 | A | | 2/2000 | Guerra | |
| 6,499,497 | B1 | | 12/2002 | Swetish et al. | |
| 6,718,565 | B1 | * | 4/2004 | Cruz | 4/476 |
| 6,892,744 | B2 | | 5/2005 | Feldpausch et al. | |
| 6,962,188 | B2 | * | 11/2005 | Coenraets | 160/180 |
| 7,044,083 | B2 | * | 5/2006 | Farmer et al. | 119/474 |
| 7,322,315 | B2 | * | 1/2008 | Brewer et al. | 119/498 |
| 7,475,699 | B2 | | 1/2009 | Johnson et al. | |
| 7,677,260 | B2 | * | 3/2010 | Sumner | 135/117 |
| 2002/0069904 | A1 | | 6/2002 | Robinson | |
| 2002/0134416 | A1 | | 9/2002 | Feldpausch et al. | |
| 2003/0116287 | A1 | | 6/2003 | Titus et al. | |
| 2005/0199356 | A1 | | 9/2005 | Nien et al. | |
| 2007/0125994 | A1 | * | 6/2007 | Henning | 256/12.5 |
| 2009/0065039 | A1 | * | 3/2009 | Livacich et al. | 135/123 |

* cited by examiner

*Primary Examiner* — Noah Chandler Hawk
(74) *Attorney, Agent, or Firm* — Holland & Hart

(57) ABSTRACT

A ground blind that includes a collapsible support structure, a flexible cover, and a window assembly. The flexible cover is mounted to the collapsible support structure. The window assembly defines a window opening in the cover and includes a flexible window panel, at least one follower, and at least one track portion. The at least one follower is carried by the window panel and has at least one follower end portion. The at least one track portion is sized to receive the at least one follower end portion. The at least one follower end portion is adjustably positioned within the at least one track portion to alter the window opening.

20 Claims, 24 Drawing Sheets

WINDOW ADJUSTMENT SYSTEM FOR BLINDS

TECHNICAL FIELD

The present application is directed to shelters for use by sportsmen, and more particularly relates to window adjustment systems for use in shelters such as portable, collapsible blinds.

BACKGROUND

Hunters, photographers, bird watchers, etc. ("sportsmen") often desire or have a need to remain hidden from view of wildlife they are observing or pursuing. Portable and collapsible shelters or blinds ("blind") are often used to hide the sportsman from view. Blinds typically include a collapsible support structure and a camouflage fabric cover secured to the support structure. The blind is set up for use by expanding the collapsible support structure to create an internal spaced within which the sportsman may enter through a door defined in the cover.

Blinds typically include multiple access openings such as at least one window and a door. Window openings in the blind are often opened and closed using a zipper. Unzipping the window zipper typically results in a fixed sized window opening that may be made smaller by moving the zipper toward a closed position. A position of the zipper on the cover defines the window size, shape and orientation. When the zipper is at least partially unzipped, a flap of window material hangs loosely. The sportsman typically retains or collects the window flap using, for example, a cord or strap.

Reducing noise is often an important objective for sportsmen, especially when the sportsman is observing game animals. Operating a zipper creates a distinctive noise that may be startling to game (e.g., animals and birds). The use of zippers in a blind creates disadvantages when trying to conceal a sportsman from being noticed in the wild and adjust aspects of an access opening. Further, the use of a zipper for a window opening limits the possible sizes, shapes and orientations for the window, and creates a window flap that the sportsman must collect.

SUMMARY

One aspect of the present disclosure relates to a ground blind that includes a collapsible support structure, a flexible cover, and a window assembly. The flexible cover is mounted to the collapsible support structure. The window assembly defines a window opening in the cover and includes a flexible window panel, at least one follower, and at least one track portion. The at least one follower is carried by the window panel and has at least one follower end portion. The at least one track portion is sized to receive the at least one follower end portion. The at least one follower end portion is adjustably positioned within the at least one track portion to alter the window opening.

The at least one track portion may be arranged vertically and the at least one follower end portion may be movable vertically within the at least one track portion. The window assembly may include first and second track portions positioned on opposing sides of the window panel, and the at least one follower may include first and second follower end portions extending into the first and second track portions, respectively. The at least one follower may include an elongate rod. The at least one track portion may include at least one elastic member operable to control an opening into the at least one track portion. The at least one track portion may impose a restrictive force on the at least one follower to maintain an adjusted position of the at least one follower end portion in the at least one track portion.

The window assembly may include first and second window panels, and first and second followers carried by the first and second window panels, respectively. The at least one track portion may be sized to receive end portions of the first and second followers. The first and second window panels may define first and second window edges, respectively, that define the window opening. Adjusting a position of the end portions of either of the first and second followers within the at least one track portion may adjust at least one of a size and a position of the window opening relative to the cover.

Another aspect of the present disclosure relates to a method of adjusting an access opening in a blind. The method includes providing a blind having a collapsible support structure, a flexible cover, and a window assembly, wherein the window assembly includes a window panel attached to the cover, at least one follower carried by the window panel, and at least one track portion sized to receive an end portion of the at least one follower. The method also includes moving the end portion of the at least one follower within the at least one track portion to adjust the window panel, and applying a retention force with the at least one track portion to maintain the adjustment of the window panel.

Adjusting the window panel may change at least one of a size and a position of a window opening defined by the window assembly. The window assembly may include first and second window panels attached to the cover, first and second followers carried by the first and second window panels, respectively, and at least one track portion sized to receive end portions of the first and second followers. The method may include moving the end portions of the first and second followers within the at least one track portion to adjust the first and second window panels.

The method may include applying a retention force with the at least one track portion to maintain the adjustment of the first and second window panels. The window assembly may include first and second track portions and the at least one follower includes first and second end portions positioned in the first and second track portions, respectively. The method may include moving at least one of the first and second end portions of the at least one follower within the first and second track portions to adjust at least one of a position and an orientation of the window panel. The at least one track portion may be arranged vertically, and moving the end portion of the at least one follower within the at least one track portion to adjust the window panel may include moving the at least one follower vertically to adjust a vertical position of the window panel relative to the cover.

A further aspect of the present disclosure relates to a window adjustment system for blinds that includes a window panel, a follower, and first and second track portions. The follower is carried by the window panel and has first and second follower end portions. The first and second track portions are sized to receive the first and second follower end portions, respectively. The first and second follower end portions are independently adjustable within the first and second track portions, respectively, to alter a window opening.

The first and second track portions may be arranged vertically, and the first and second follower end portions may be adjustable vertically within the first and second track portions, respectively. The window panel may include a flexible material. The first and second track portions may be configured to releasably retain the first and second follower end portions in an adjusted position. The window adjustment system may also include first and second window panels, and first and second followers carried by the first and second window panels, respectively. The first and second followers may each include first and second follower end portions, wherein the first track portion is configured to receive the first follower end portions of the first and second followers, and the second track portion is configured to receive the second follower end portions of the first and second followers.

The first and second window panels may be adjustable to close the window opening, wherein the first and second window panels at least partially overlap each other when the window opening is closed. The window panel may overlap at least a portion of the first and second track portions.

Another aspect of the present disclosure relates to a ground blind window assembly that includes a window opening, first and second window panels, and a plurality of independently operable adjustment members. The first window panel includes opposing side edges and a first window edge. The second window panel includes opposing side edges and a second window edge. The plurality of independently operable adjustment members are configured to adjust the first and second window panels between an open position wherein at least a portion of the window opening is exposed between the first and second window edges, and a closed position covering the window opening. A separate adjustment member is operable at each of the side edges.

The plurality of adjustment members include zipper fasteners. The first and second window edges are movable toward and away from each other upon operation of the adjustment members. The ground blind window assembly may further include a separate biasing member connected to each of the first and second window panels. The biasing member may be operable to automatically move the first and second window panels from the closed position to the open position upon operation of the plurality of adjustment members. The ground blind window assembly may also include a separate biasing member connected to each of the first and second window panels, wherein the biasing members are operable to gather portions of the first and second window panels when in the open position.

Another aspect of the present disclosure relates to a method of operating a window assembly of a ground blind. The method includes providing the window assembly with first and second window panels, and a plurality of adjustment members, wherein the first and second window panels each include opposing side edges and a window edge extending between the side edges. The method also includes independently operating one of the plurality of adjustment members along each of the side edges to adjust the window assembly between open and closed positions.

The first and second window panels may be arranged with the window edges movable away from and toward each other to open and close the window assembly, respectively. The plurality of adjustment members may include zipper fasteners, and independently operating the plurality of adjustment members includes operating the zipper fasteners in parallel directions.

BRIEF DESCRIPTION OF THE DRAWINGS

The accompanying drawings illustrate a number of embodiments of the instant disclosure and are part of the specification. Together with the following description, the drawings demonstrate and explain principles of the instant disclosure.

Figure 1:
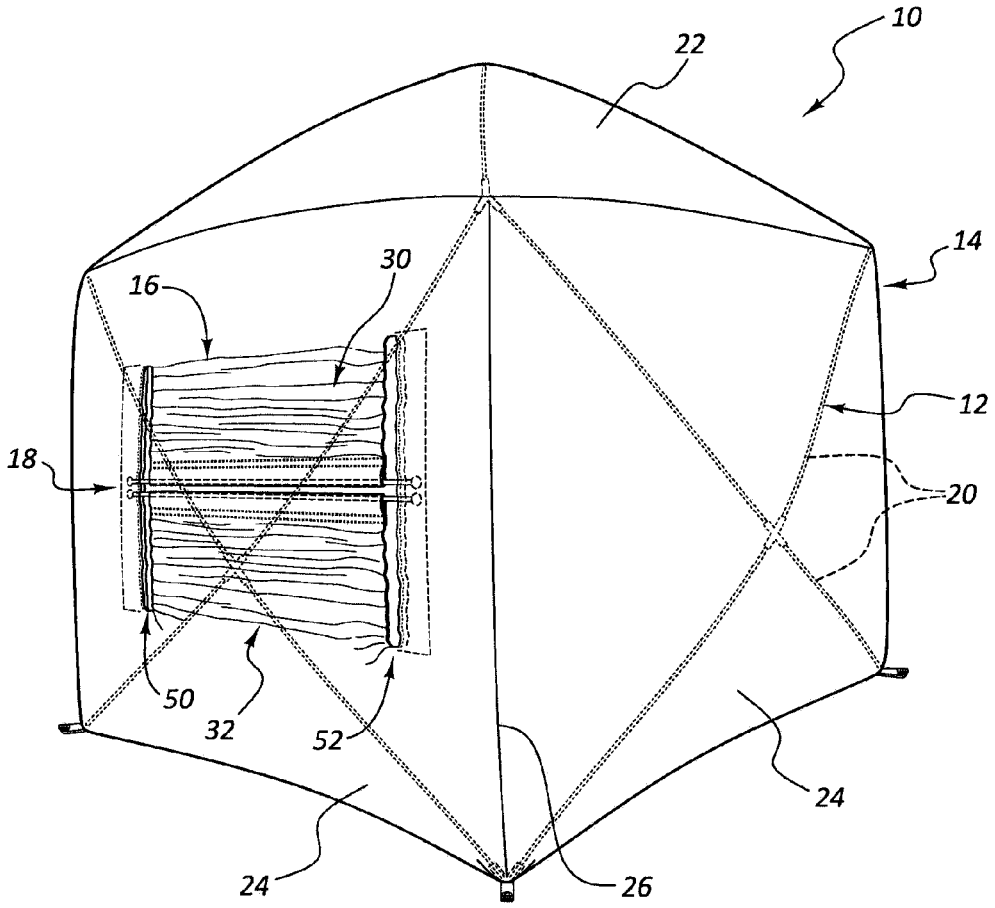
FIG. 1 is a perspective view of an example collapsible ground blind having a window adjustment system with two window panels in accordance with the present disclosure.

Throughout the drawings identical reference characters and descriptions indicate similar, but not necessarily identical, elements. While embodiments of the instant disclosure are susceptible to various modifications and alternative forms, specific embodiments have been shown by way of example in the drawings and will be described in detail herein. However, one of skill in the art will understand that embodiments of the instant disclosure are not intended to be limited to the particular forms disclosed herein. Rather, the instant disclosure covers all modifications, equivalents, and alternatives falling within the scope of embodiments defined by the appended claims.

DETAILED DESCRIPTION

The present disclosure is directed to ground blind assemblies and access openings into ground blind assemblies. An example ground blind assembly may include a collapsible ground blind construction. The access opening of the ground blind assembly may include an adjustment system used to control opening and closing of the access opening. In one example, the access opening is a window of the ground blind assembly and the adjustment system is referred to as a window adjustment system. Other types of access openings may benefit from the adjustment systems disclosed herein. For example, a vent or door access opening of a ground blind assembly may include aspects of the adjustment systems disclosed herein.

An example window adjustment system includes at least one window panel. The window panel typically comprises a flexible material such as fabric. The window panel is adjusted between various positions and may be maintained in different adjusted positions. The window panel may automatically maintain any given adjust position until further adjusted by an operator. Moving the window panel into an adjusted position may alter a size of a window opening, shape of a window opening, or position of a window opening relative to a cover of the ground blind assembly. The cover of the ground blind assembly is typically connected to a support structure such as a collapsible support structure to help define an interior of the ground blind assembly when the ground blind assembly is set up for use.

In some examples, the window adjustment system includes a plurality of window panels. The window panels may be independently adjustable. Moving any one of the window panels into an adjusted position may adjust at least one of a size, shape, or relative position of a window opening on the ground blind assembly.

The window panels of the window adjustment system may have various shapes and sizes. For example, the window panel may be generally rectangular-shaped and be configured and operable to substantially close or cover a rectangular-shaped opening in the cover of the ground blind assembly. In other arrangements, window panels having alternative shapes such as triangular, hexagonal, or circular shapes and be configured to substantially cover a similar shaped opening defined in the cover. In some arrangements, the shape of the window panel may be different from the shape of the opening in the cover being covered by the window adjustment system.

The window panels may be configured to change shape as part of being adjusted to different positions when adjusting at least one of a size, shape and relative position of an opening in the cover. The window panel may include a collection of surplus material that permits moving the window panel into different positions and orientations, and may permit distorting a shape of the window panel when adjusting the window panel or adjusting the window adjustment system generally. The window panels may include at least one elastic member that provides some tension in the window panels to resist flapping or other undesired movement of the surplus material.

Referring now to FIGS. 1-4, an example collapsible ground blind 10 is shown including a support structure 12, a cover 14, and a window adjustment system 16. The window adjustment system 16 may define a window opening 18 that provides access into the interior of the collapsible ground blind 10.

The support structure 12 includes a plurality of frame members 20. The cover 14 is attached to the support structure. The support structure 12 may be collapsible into a collapsed position that facilitates easier transport of the collapsible ground blind 10. Expanding the support structure 12 into an expanded position with the cover 14 mounted to the support structure defines an interior space within the collapsible ground blind 10 (see FIG. 1).

The cover 14 includes a top 22, a plurality of side panels 24, and a plurality of side corners 26 defined at an intersection between adjacent side panels 24. The window adjustment system 16 may be positioned entirely on one of the side panels 24. Alternatively, the window adjustment system 16 may span one of the side corners 26 and be positioned at least partially on adjacent side panels 24. In other arrangements, the window adjustment system 16 may be positioned at least partially on the top 22.

Figure 2:
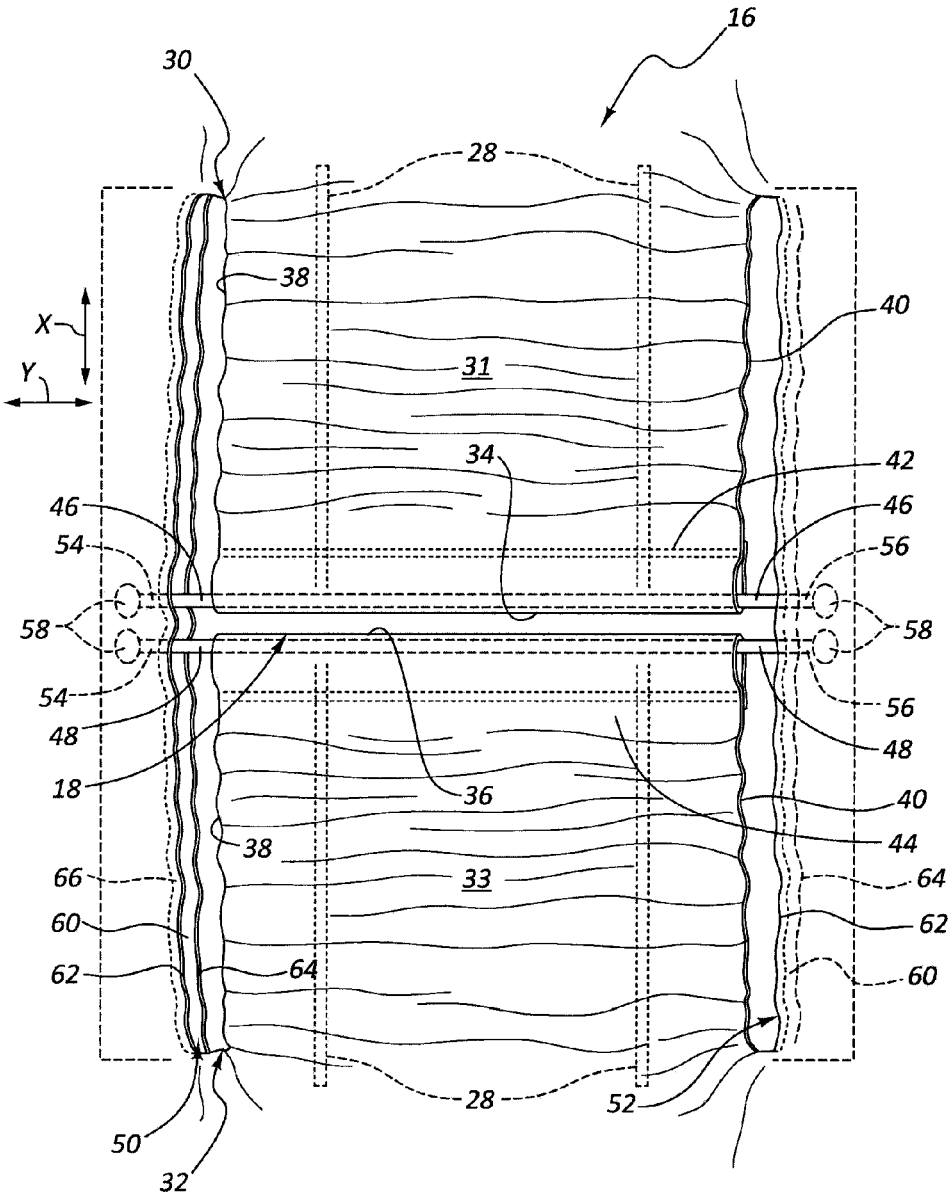
FIG. 2 is close-up view of the window adjustment system shown in FIG. 1.

Referring to FIG. 2, the window adjustment system 16 includes first and second window panels 30, 32, first and second panel opening edges 34, 36 positioned on the first and second window panels 30, 32, respectively, and opposing panel side edges 38, 40 on each of the first and second window panels 30, 32. First and second followers 46, 48 may be carried by the first and second window panels 30, 32.

The first and second window panels 30, 32 may include surplus material 31, 33, respectively, that permits adjustment of the first and second window panels 30, 32 into different positions and orientations. The first and second window panels 30, 32 may include at least one gathering member 28 (see FIG. 2) that provides at least some gathering function for the surplus material 31, 33. The gathering members 28 may automatically apply at least some tension in the first and second window panels 30, 32 that limit flapping, hanging, or other undesired movement of the surplus material 31, 33. In one example, the gathering members 28 include at least one length of elastic material. The elastic material may be connected to the first and second window panels 30, 32 using, for example, sewing or adhesives.

The first and second followers 46, 48 may be retained within first and second follower sleeves 42, 44, respectively, that are defined in the first and second window panels 30, 32. Portions of the first and second followers 46, 48 may extend into first and second follower tracks 50, 52. The first and second followers 46, 48 may move within the first and second follower tracks 50, 52 to adjust at least one of a size, shape, and relative position of the window opening 18.

The first and second followers 46, 48 may each include opposing first and second end portions 54, 56. The first and second end portions 54, 56 may extend into the first and second follower tracks 50, 52, respectively. A friction member 58 may be positioned at and mounted to the first and second end portions 54, 56. A friction member 58 may provide an increased friction interface between the first and second followers 46, 48 and the first and second follower tracks 50, 52. In one example, the friction member 58 has an enlarged shape (e.g., enlarged diameter) as compared to the remaining portions of the first and second followers 46, 48. The friction member 58 may include a high friction material. In other examples, the friction member 58 includes a deformable material such as, for example, a material that is compressible or changes shape. The friction member 58 may assist in maintaining the first and second end portions 54, 56 within the first and second follower tracks 50, 52 when adjusting the window panels 30, 32.

The first and second follower tracks 50, 52 may each include a track opening 60 defined by first and second track edges 62, 64. At least one of the first and second track edges 62, 64 may include a tension member 66 such as, for example, an elastic member. The size and construction of the track opening 60 defined by the first and second track edges 62, 64 may apply a restricting force to the first and second followers 46, 48 that helps maintain a position of the first and second followers 46, 48 within the first and second follower tracks 50, 52. The restricting force may be applied to the first and second followers 46, 48 at a location along the length of the first and second followers 46, 48. In other arrangements, the restrictive force may be applied to the friction member 58 or other features of the first and second followers 46, 48 such as, for example, along the first and second end portions 54, 56.

The first and second follower tracks 50, 52 may be configured to permit movement of the first and second followers 46, 48 along a length direction of the first and second follower tracks 50, 52 in the X direction (see FIG. 2). Movement in the length direction is typically possible upon application of a force that exceeds a threshold level to one of the first and second followers 46, 48 in the length direction X. The first and second followers 46, 48 maintain a given X position within the first and second follower tracks 50, 52 until the threshold force is exceeded in the X direction. A user may apply a force that exceeds the threshold force in the X direction to adjust a position of either or both of the first and second followers 46, 48 for each of the window panels 30, 32 to adjust a position and orientation of the first and second panel opening edges 34, 36. The first and second followers 46, 48 may automatically maintain whatever position in the X direction achieved upon removal of the force that exceeds the threshold force.

The first and second follower tracks 50, 52 may also permit some movement of the first and second followers 46, 48 in a lateral or Y direction (see FIG. 2). Some movement in the Y direction may occur when moving only one or the other of the first and second end portions 54, 56 in the X direction along the length of the first and second follower tracks 50, 52. FIGS. 3D and 3E show different configurations and arrangements of the first and second panel opening edges 34, 36 by adjusting a position of only one of the first or second end portions 54, 56 in the X direction for each of the window panels 30, 32. Such adjustment may laterally move the first and second followers 46, 48 relative to the first and second follower tracks 50, 52. Preferably, the first and second follower tracks 50, 52 are configured to retain the first and second end portions 54, 56 for typical adjusted arrangements of the first and second panel opening edges 34, 36. In some arrangements, applying a force to the first and second followers 46, 48 in the Y direction that exceeds a threshold force will remove one of the first and second end portions 54, 56 from one of the first and second follower tracks 50, 52.

The tension member 66 of the first and second follower tracks 50, 52 may be positioned on one or both of the first and second track edges 62, 64. The tension member 66 may have various constructions and include different materials. In one example, the tension member 66 includes an elastic material. In other arrangements, the tension member 66 includes an elongated rod that helps maintain the track opening 60 in a restricted or closed position, or a position in which the track opening 60 is biased toward a closed position.

Figure 3A:
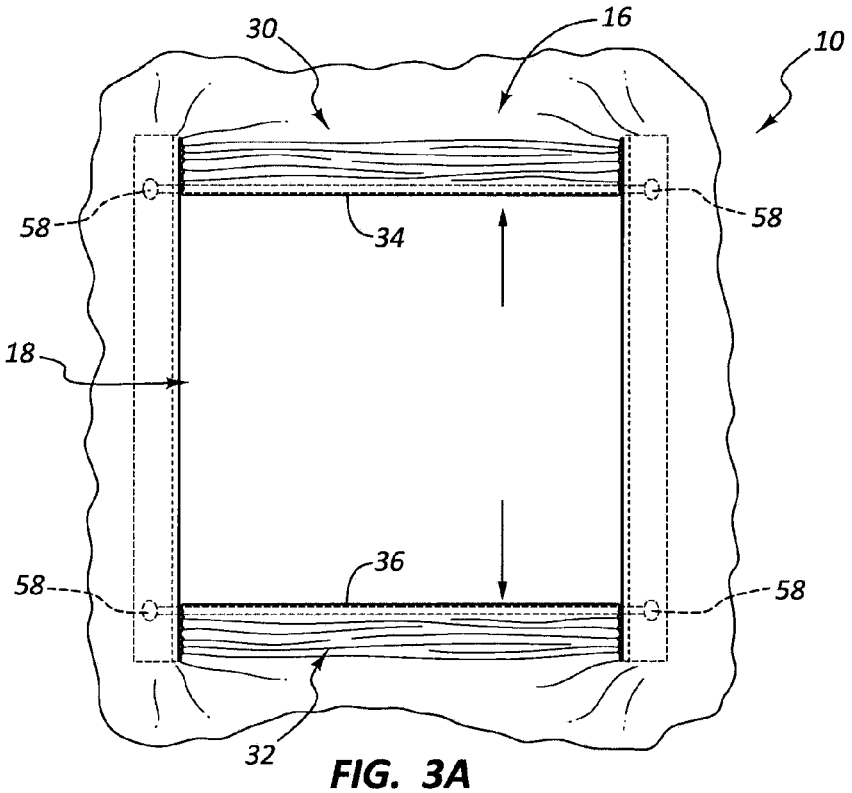
FIGS. 3A-F show different adjusted positions of the window adjustment system of FIG. 1.
Figure 3B:
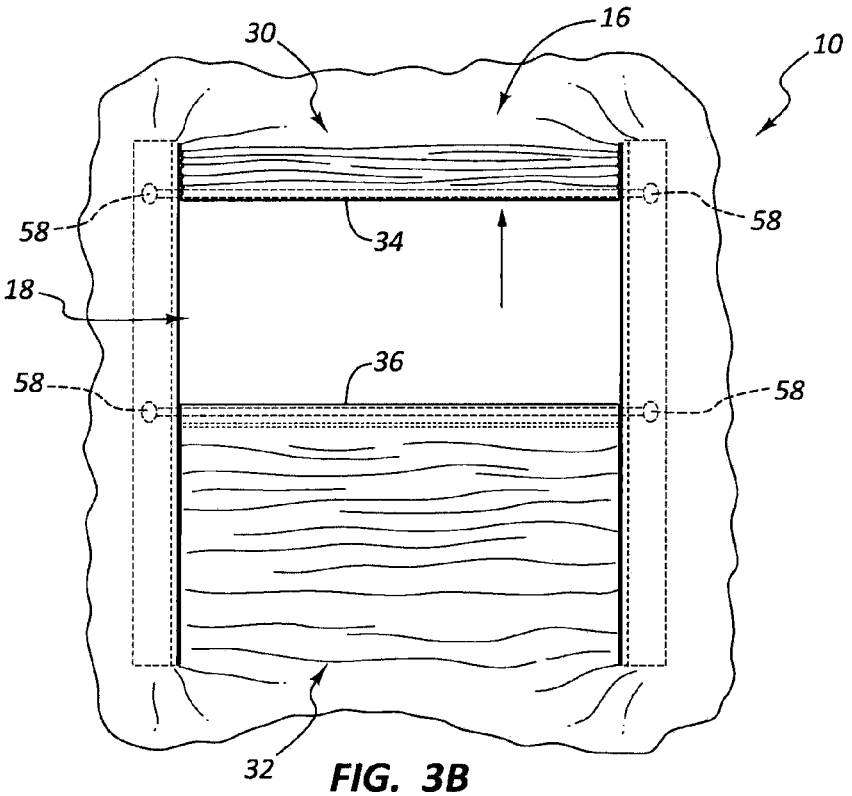
Figure 3C:
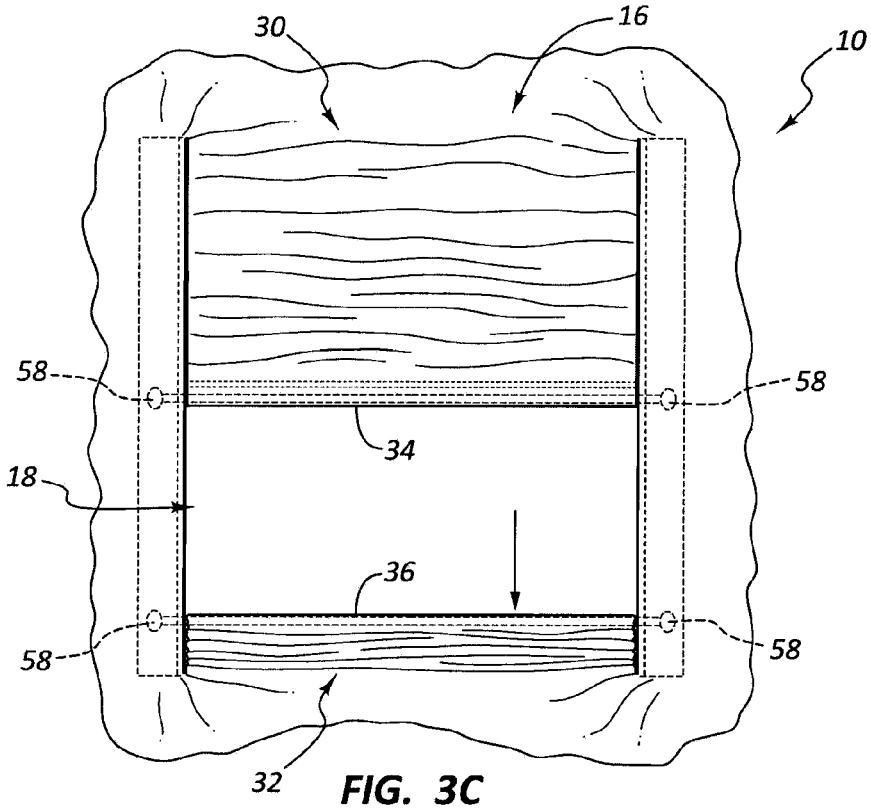
Figure 3D:
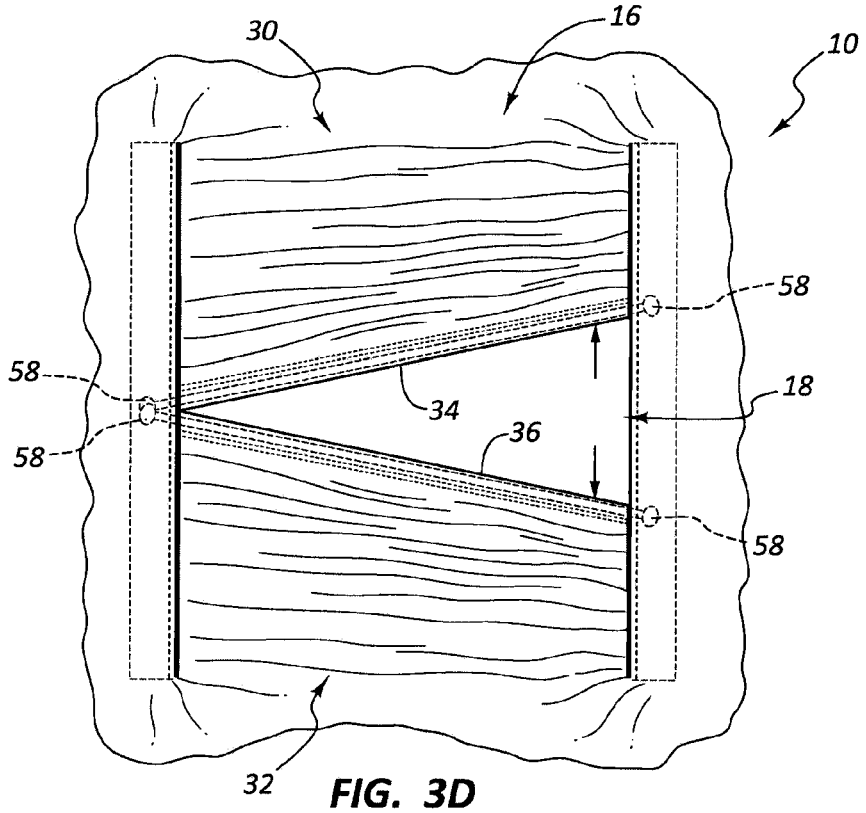
Figure 3E:
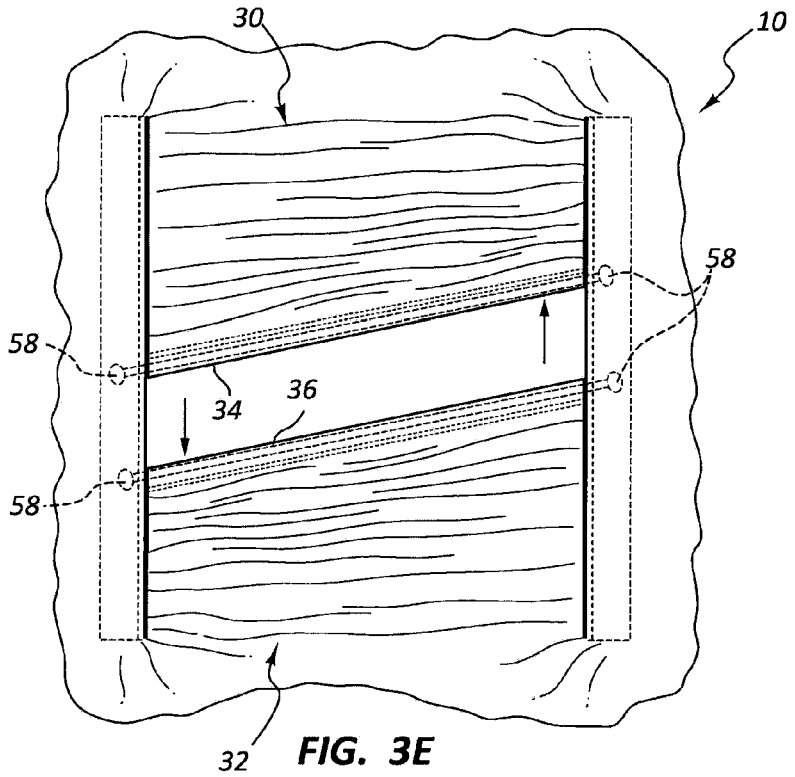

Referring to FIGS. 3A-F, several adjusted configurations for the window panels 30, 32 of the window adjustment system 16 are shown. FIG. 3A shows the first and second window panels 30, 32 adjusted away from each other in equal amounts to enlarge a size of the window opening 18 while maintaining a position of the window 18. The shape of the window 18 may remain rectangular shaped, while the particular rectangular shape may change as the window 18 is opened or enlarged. A position of the window opening 18 remains unchanged. Adjusting a position of the window 18 may be defined as moving a center point, centerline, or center plane of the window opening 18 vertically or horizontally relative to the cover 14 of the collapsible ground blind 10.

Referring to FIG. 3B, the first window panel 30 is adjusted by moving away from the second window panel 32. In this arrangement, the size and position of the window 18 are changed as the first window panel 30 is adjusted. The relative position of the window 18 moves upward. Similar to FIG. 3A, the window 18 maintains a rectangular shape.

FIG. 3C shows a similar adjustment to FIG. 3B, but with the second window panel 32 adjusted while the first window panel 30 remains fixed. In this arrangement, the size and position of the window 18 are changed, while the shape of the window 18 is maintained as rectangular. In each of the examples shown in FIGS. 3A-C, both of the first and second end portions 54, 56 are moved an equal distance within the first and second follower tracks 50, 52 so that the first and second panel opening edges 34, 36 remain in substantially the same orientation (e.g., arranged horizontally as the first and second panel opening edges 34, 36 move vertically).

Referring to FIG. 3D, only one of the first and second end portions 54, 56 of the first and second followers 46, 48 are adjusted for each of the first and second window panels 30, 32. The second end portion 56 of the first follower 46 is adjusted while the second end portion 54 of the first follower 46 is maintained in a fixed position. This provides a skewed or angled orientation for the first panel opening edge 34. The second end portion 56 of the second follower 48 may also be adjusted away from the first window panel 30 while the first end portion 54 of the second follower 48 maintains a fixed position. This adjustment provides a skewed or angled orientation for the second panel opening edge 36. This adjustment provides both a change in size and shape for the window opening 18. A position of the window opening 18 remains generally the same.

FIG. 3E shows an adjustment in which the second end portion 56 of the first follower 46 is adjusted while the first end portion 54 of the first follower 46 maintains a fixed position. The first end portion 54 of the second follower 48 is adjusted away from the first window panel 30 while the second end portion 56 of the second follower 48 maintains a fixed position. The first and second panel opening edges 34, 36 are both arranged at skewed or angled orientations, but in opposite angled directions. This adjustment changes both a size and shape of the window opening 18. The position of the window opening 18 remains generally constant.

A position of the window opening 18 in FIGS. 3D and 3E may be changed by moving both of the first and second end portions 54, 56 of either of the first and second followers 46, 48 after the orientation shown in FIGS. 3D and 3E have been achieved to move the first or second window panel 30, 32 toward or away from the other of the first or second window panel 30, 32. Given the construction of the window adjustment system 16 shown in FIGS. 1-2, the adjusted position is typically in a vertical direction wherein a center point, centerline or center plain of the window opening 18 is moved vertically upward or downward relative to the cover 14.

Figure 3F:
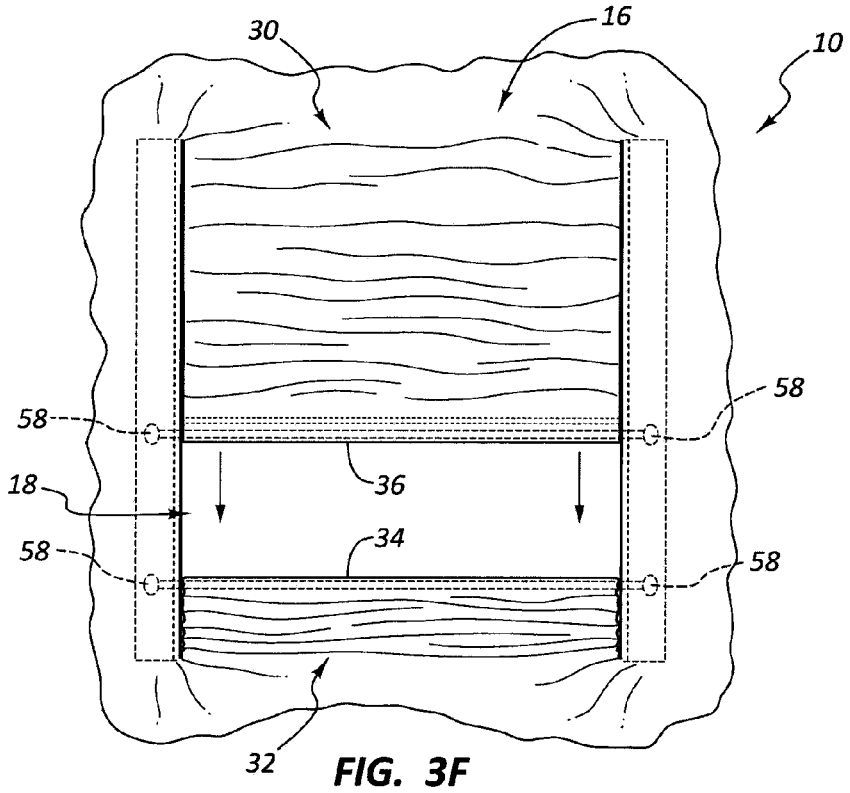

FIG. 3F shows another arrangement in which both of the first and second followers 46, 48 are adjusted in the same direction with the second follower 46 being adjusted a greater distance than the first follower 46. This adjustment provides a change in size and a change in position for the window opening 18. The window may maintain a rectangular shape. A similar adjustment may be made in an opposite direction (e.g., in a vertically upward direction rather than a vertically downward direction) in other adjustment arrangements.

Figure 4:
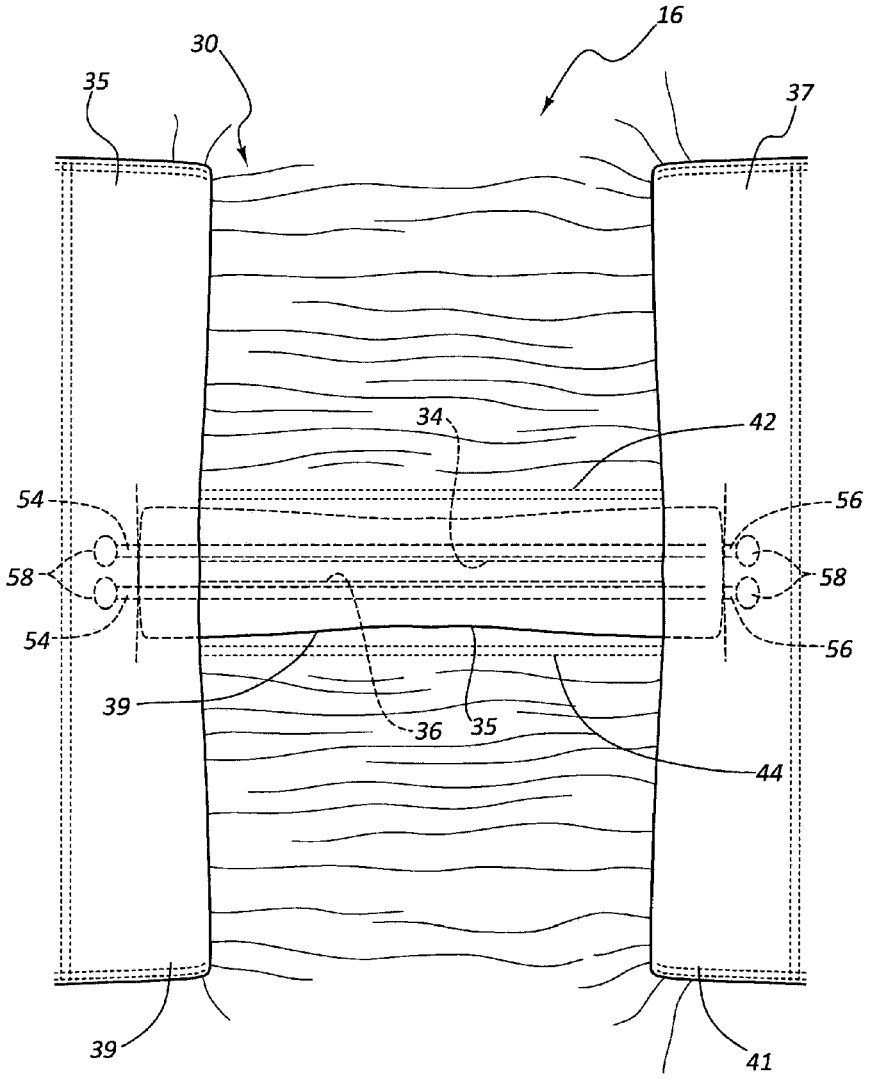
FIG. 4 shows a modified version of the window adjustment system of FIG. 1.
Figure 5:
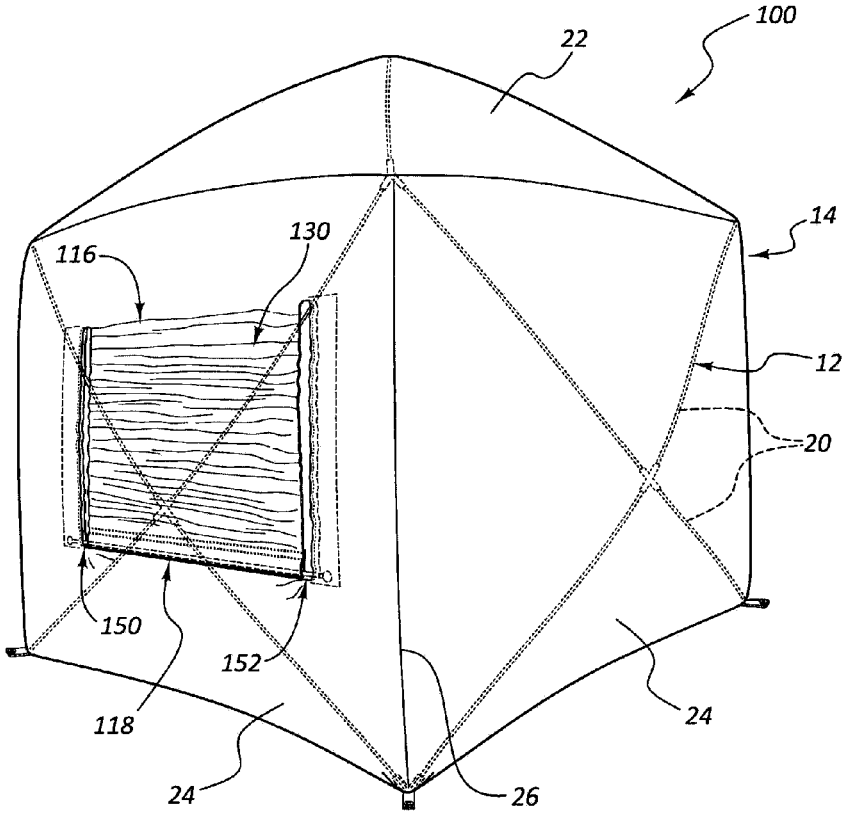
FIG. 5 shows another example collapsible ground blind having a window adjustment system with a single window panel in accordance with the present disclosure.
Figure 6:
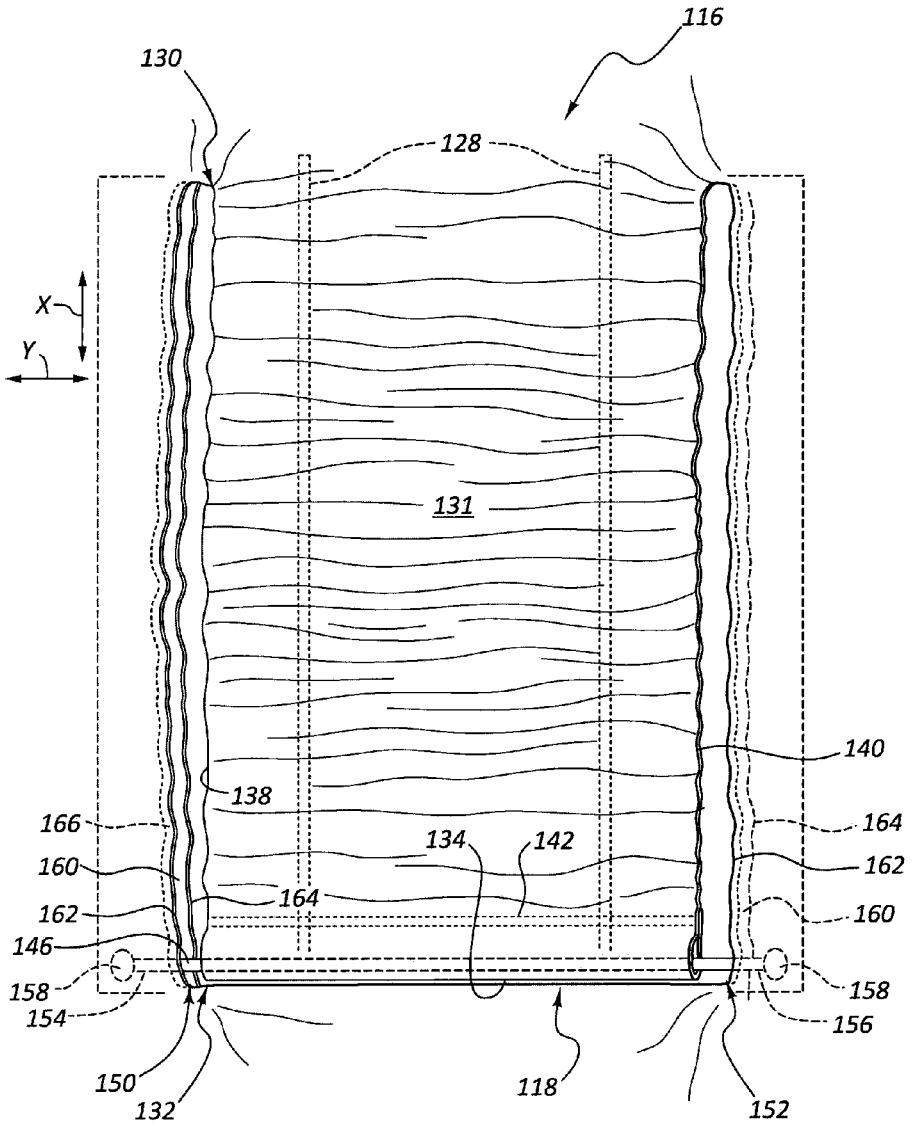
FIG. 6 is a close-up view of the window adjustment system shown in FIG. 5.

Referring to FIG. 4, the first and second window panels 30, 32 may additionally include an opening edge flap 35. The opening edge flap 35 may provide a more complete closure of the window opening 18 without having to overlap the first and second followers 46, 48. The first and second followers 46, 48 may remain spaced apart (e.g., vertically spaced apart) within the first and second follower tracks 50, 52 and the window opening 18 may maintain a closed position using the opening edge flap 35.

The first and second window panels 30, 32 may also include at least one side edge flap 39, 41 along opposing sides thereof. The side edge flaps 39, 41 may overlap and at least partially cover the first and second follower tracks 50, 52, respectively. The side edge flaps 39, 41 may cover a gap defined between the track opening 60 and the panel side edges 38, 40. The side edge flaps 39, 41 may cover or overlap the track opening 60. The opening edge flap 35 and side edge flaps 39, 41 may be helpful in controlling the flow of, for example, air, smells and sounds into or out of the collapsible ground blind 10.

Referring now to FIGS. 5-8, another example collapsible ground blind 100 is shown including a support structure 12, a cover 14, and a window adjustment system 116. The window adjustment system 116 may include a single window panel 130. The window panel 130 may be adjusted into various positions to change at least one of a shape, size, or position of a window opening 118 of the collapsible ground blind 100.

The window panel 130 may include a panel opening edge 134, opposing panel side edges 138, 140, a follower 146, and a follower sleeve 142 sized to receive the follower 146. Opposing first and second end portions 154, 156 of the follower 146 may extend into and move within first and second follower tracks 150, 152. The follower 146 may include a friction member 158 that helps retain the first and second end portions 154, 156 within the first and second follower tracks 150, 152, respectively.

The window panel 130 may include surplus material 131 that permits adjustment of the window panel 130 into different positions and orientations. The window panel 130 may include at least one gathering member 128 (see FIG. 6) that provides at least some gathering function for the surplus material 131. The gathering members 128 may automatically apply at least some tension in the window panel 130 that limits flapping, hanging, or other undesired movement of the surplus material 131. In one example, the gathering members 128 include at least one length of elastic material.

The first and second follower tracks 150, 152 may each include a track opening 160 defined by first and second track edges 162, 164. At least one tension member 166 may be positioned along at least one of the first or second track edges 162, 164 to help apply a restrictive force to the follower 146 to maintain an adjusted position of the follower 146 within the first and second follower tracks 150, 152.

Figure 7A:
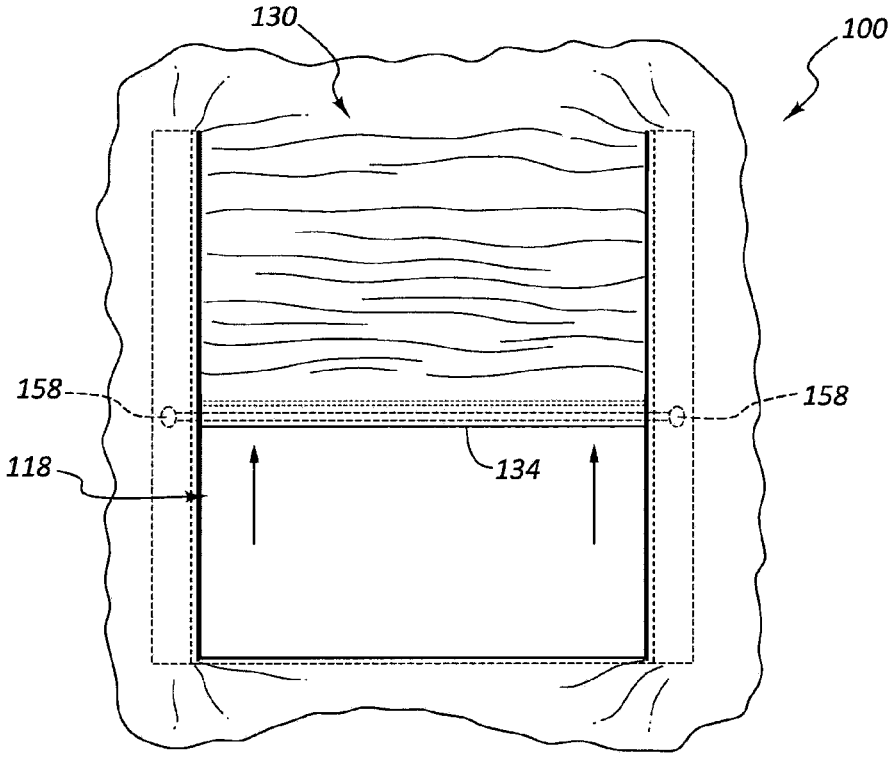
FIGS. 7A-B show different adjusted positions of the window adjustment system shown in FIG. 5.
Figure 7B:
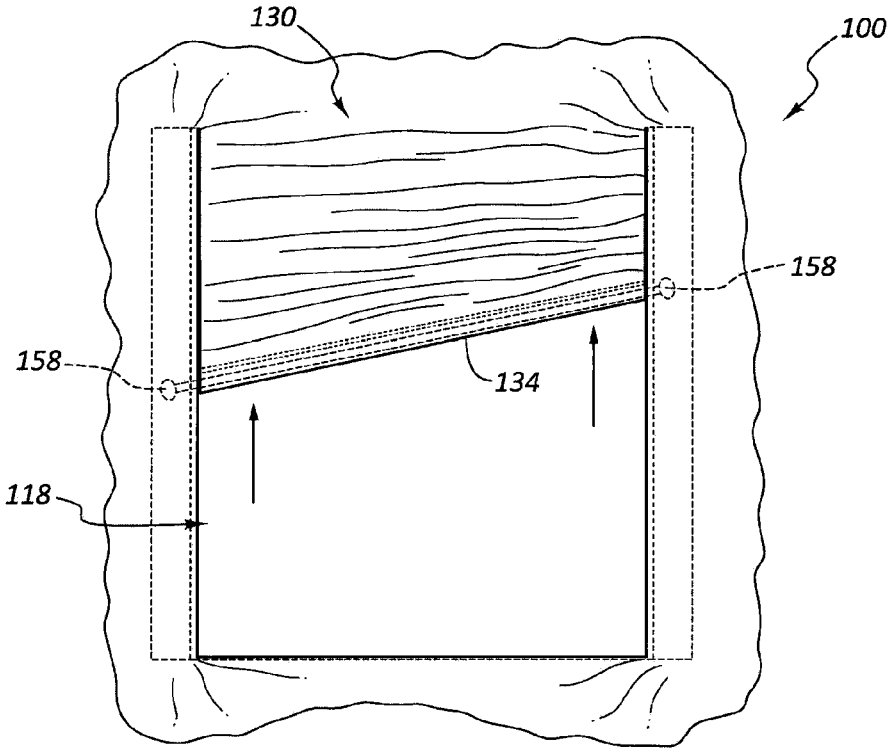

FIGS. 7A-B show different adjusted positions for the window panel 130. FIG. 7A shows the window panel 130 in an adjusted position in which the first and second end portions 154, 156 of the follower 146 are moved an equal amount. The size and position of the window opening 118 may be changed while a shape (e.g., rectangular shape) of the window opening 118 may remain unchanged. FIG. 7B shows one of the first second end portions 154, 156 adjusted a greater distance than the other to orient the panel opening edge 134 in a skewed or angled orientation. The shape, size and position of the window opening 118 may be changed in by moving the panel opening edge 134 into different orientations and positions.

Figure 8:
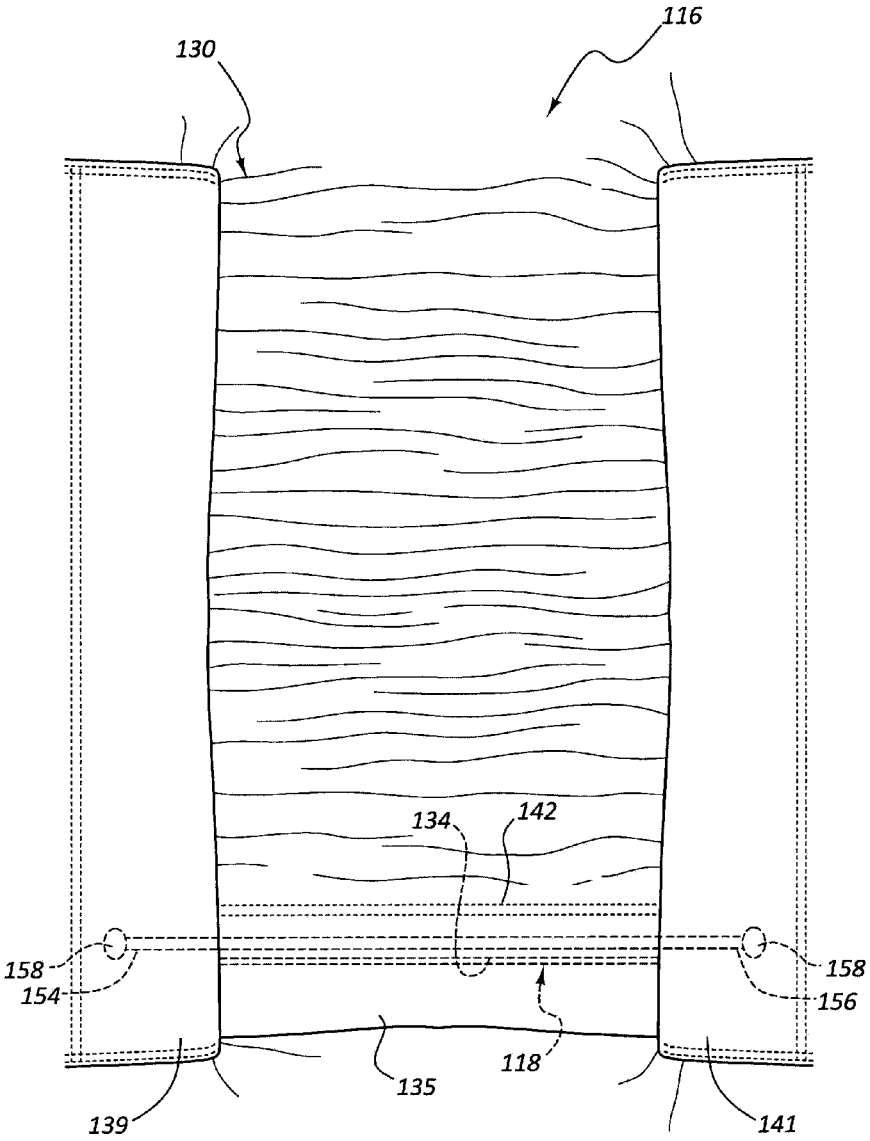
FIG. 8 is a modified version of the window adjustment system of FIG. 5.
Figure 9:
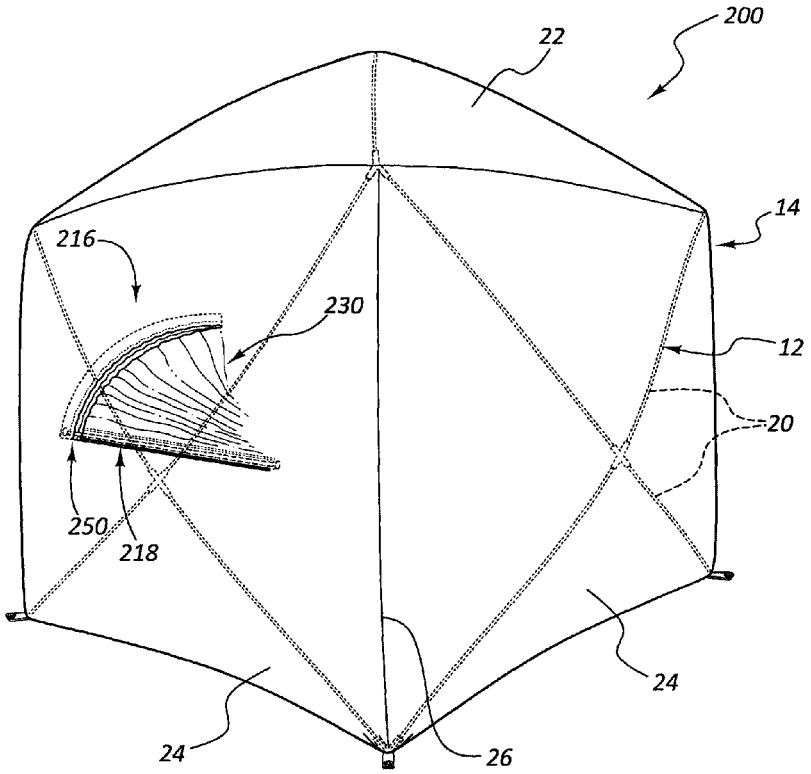
FIG. 9 shows another example collapsible ground blind with a window adjustment system in accordance with the present disclosure.
Figure 10:
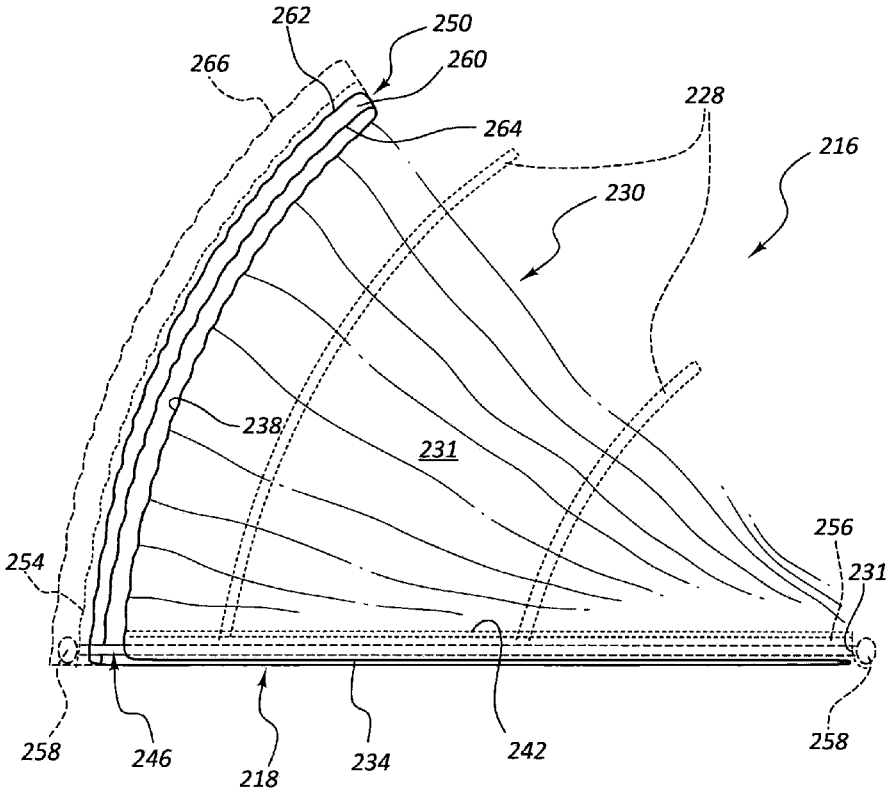
FIG. 10 is a close-up view of the window adjustment system shown in FIG. 9.

FIG. 8 shows the window panel 130 with an opening edge flap 135 and side edge flaps 139, 141. The opening edge flap 135 and side edge flaps 139, 141 may overlap gaps of the window adjustment system 116. The side edge flaps 139, 141 may overlap or cover portions of the first and second follower tracks 150, 152. The opening edge flap 135 and side edge flaps 139, 141 may control the flow of, for example, air, smells, and sounds into and out of the collapsible ground blind 100.

Referring now to FIGS. 9-12, another example collapsible ground blind 200 is shown including a support structure 12, a cover 14, and a window adjustment system 216. The window adjustment system 216 may include a single window panel 230. The window panel 230 may have a fan-shaped construction (also referred to as a triangular, conical or wedge construction). The window panel 230 may open and close through an arc adjustment path. In other arrangements, multiple window panels of similar construction may be positioned adjacent to each other. Using multiple window panels may increase a maximum possible size of a window opening 218 of the collapsible ground blind 200 and may provide additional options for adjusting a size and position of the window opening 218.

The window panel 230 includes a panel opening edge 234, a panel side edge 238, a follower 246, and a follower sleeve 242 sized to receive the follower 246. The follower 246 may have an end portion 254 arranged to extend into and move within a follower track 250. The follower 246 may include a friction member 258 that helps retain a position of the end portion 254 within the follower track 250.

The window panel 230 may include surplus material 231 that permits adjustment of the window panel 230 into different positions and orientations. The window panel 230 may include at least one gathering member 228 (see FIG. 10) that provides at least some gathering function for the surplus material 231. The gathering members 228 may automatically apply at least some tension in the window panel 230 that limits flapping, hanging, or other undesired movement of the surplus material 231. In one example, the gathering members 228 include at least one length of elastic material.

The follower track 250 may include a track opening 260 defined by first and second track edges 262, 264. At least one tension member 266 may be positioned along at least one of the first and second track edges 262, 264 to assist in applying a retention force to the follower 246.

The window panel 230 may open and close about a pivot point 231. The pivot point 231 may be defined by a second end portion 256 of the follower 246. The pivot point may be positioned at any location along a length of the panel opening edge 234.

Figure 11A:
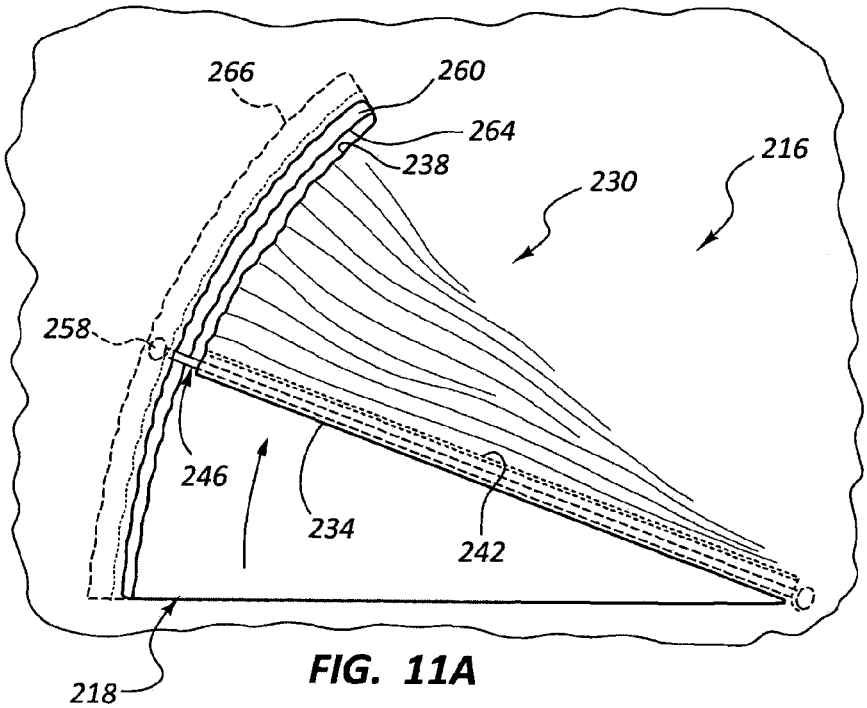
FIGS. 11A-B show different adjusted positions of the window adjustment system of FIG. 9.
Figure 11B:
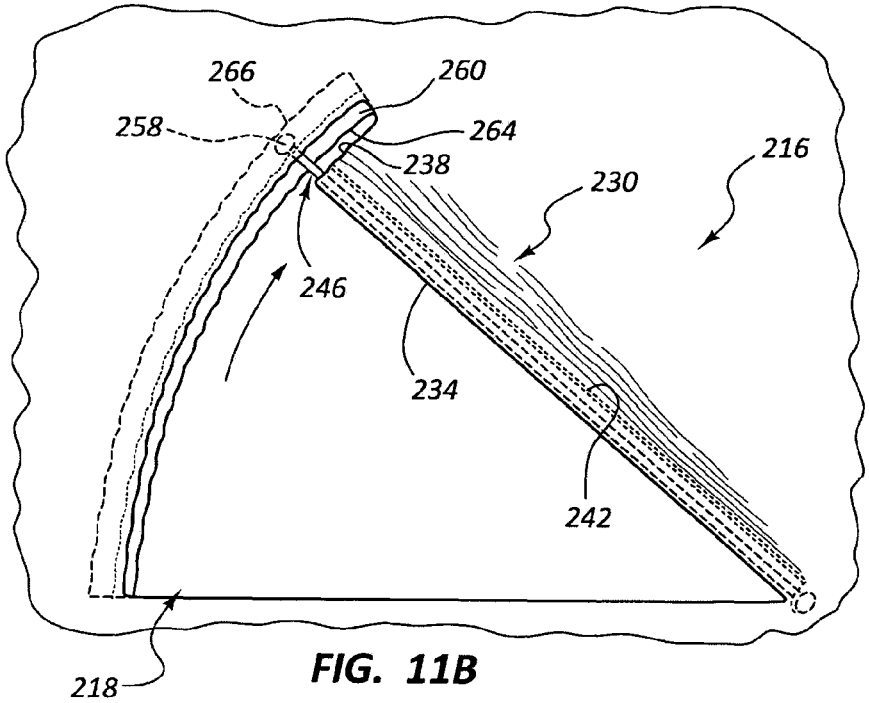

FIGS. 11A-B show different adjusted positions for the window panel 230. FIG. 11A shows the first end portion 254 adjusted along a length of the follower track 250 to partially open the window opening 218. FIG. 11B shows the window panel 230 moved into a fully open position to provide a maximum size for the window opening 218.

Figure 12:
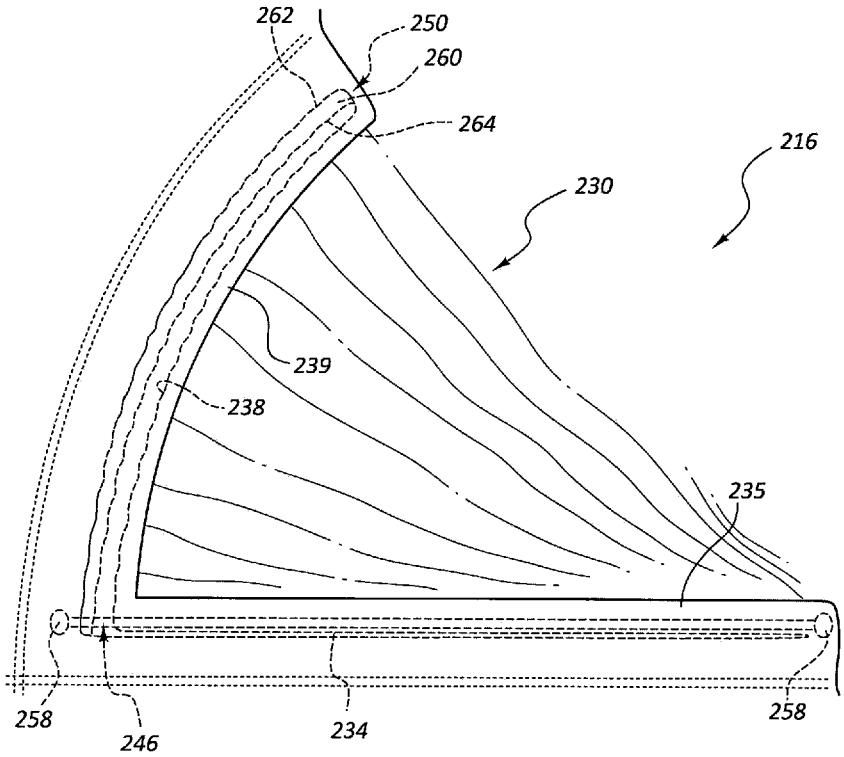
FIG. 12 shows a modified version of the window adjustment system of FIG. 9.
Figure 13:
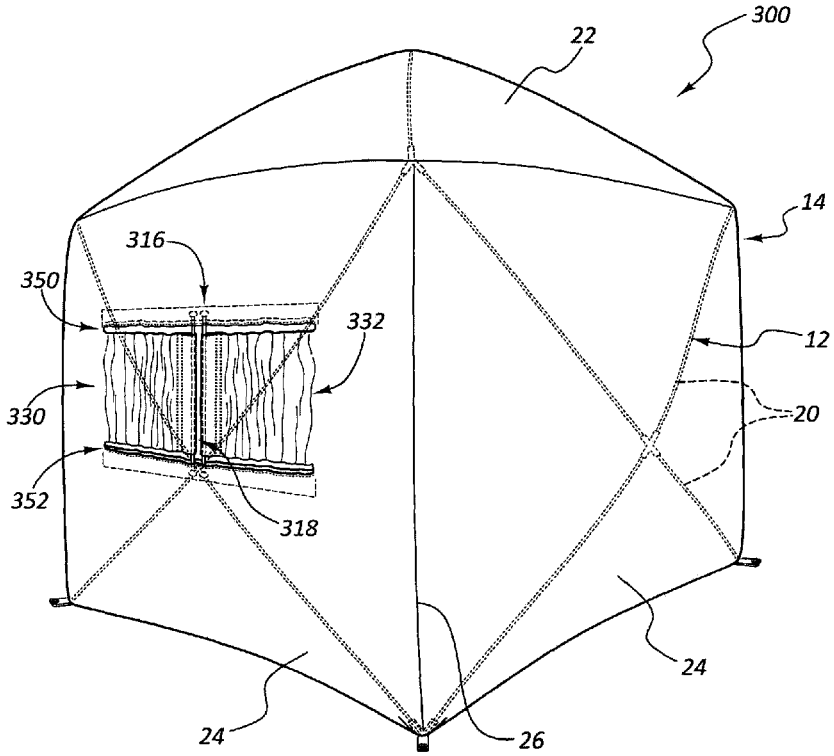
FIG. 13 shows another example collapsible ground blind having a horizontally operable window adjustment system in accordance with the present disclosure.
Figure 14:
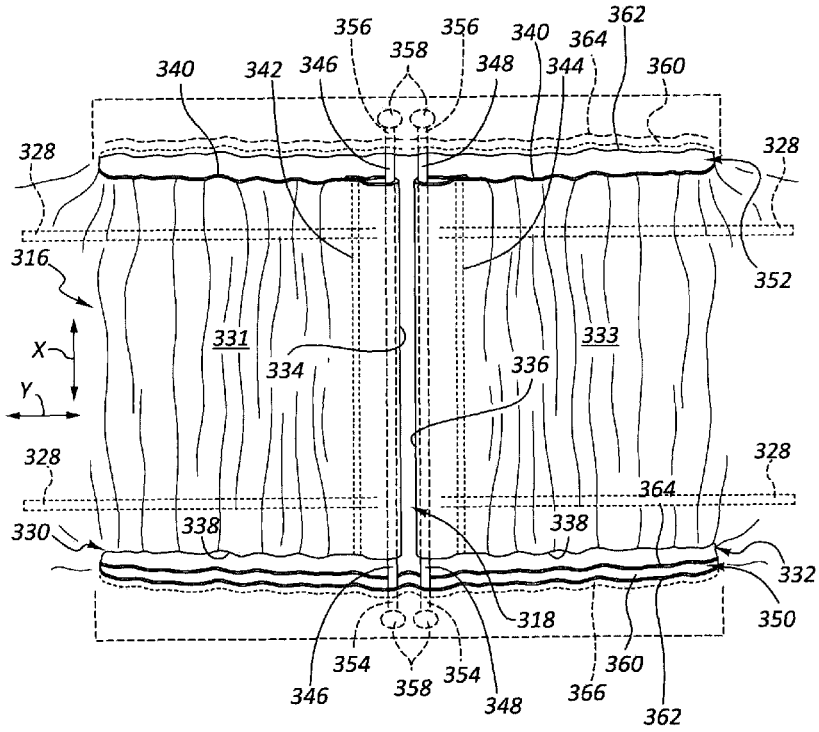
FIG. 14 is a close-up view of the window adjustment system of FIG. 13.
Figure 15A:
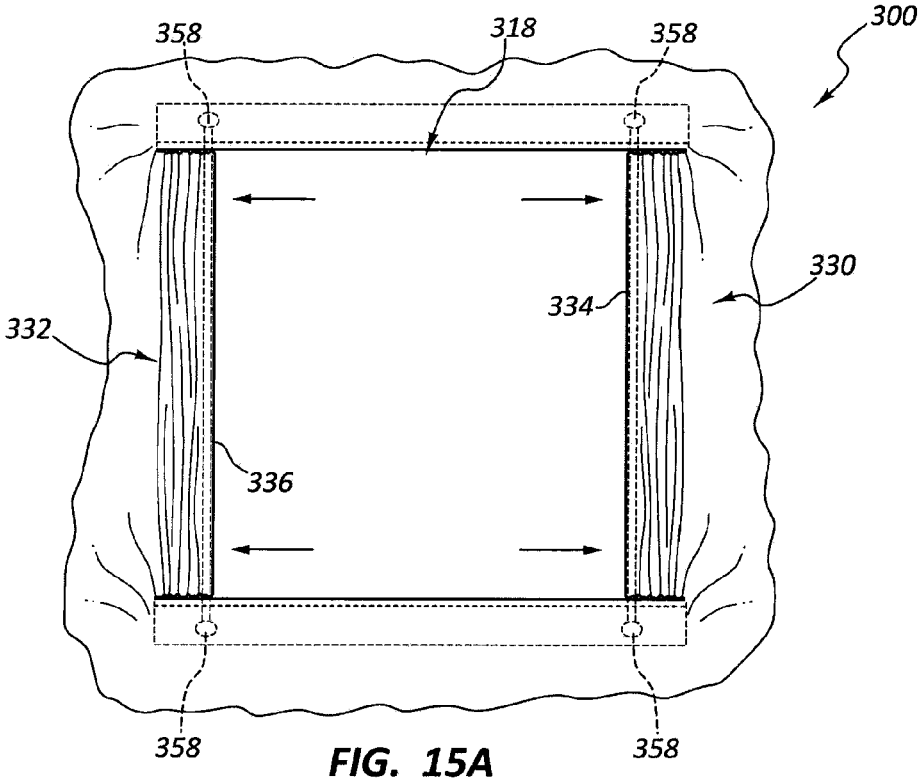
FIGS. 15A-E show different adjusted positions of the window adjustment system of FIG. 13.
Figure 15B:
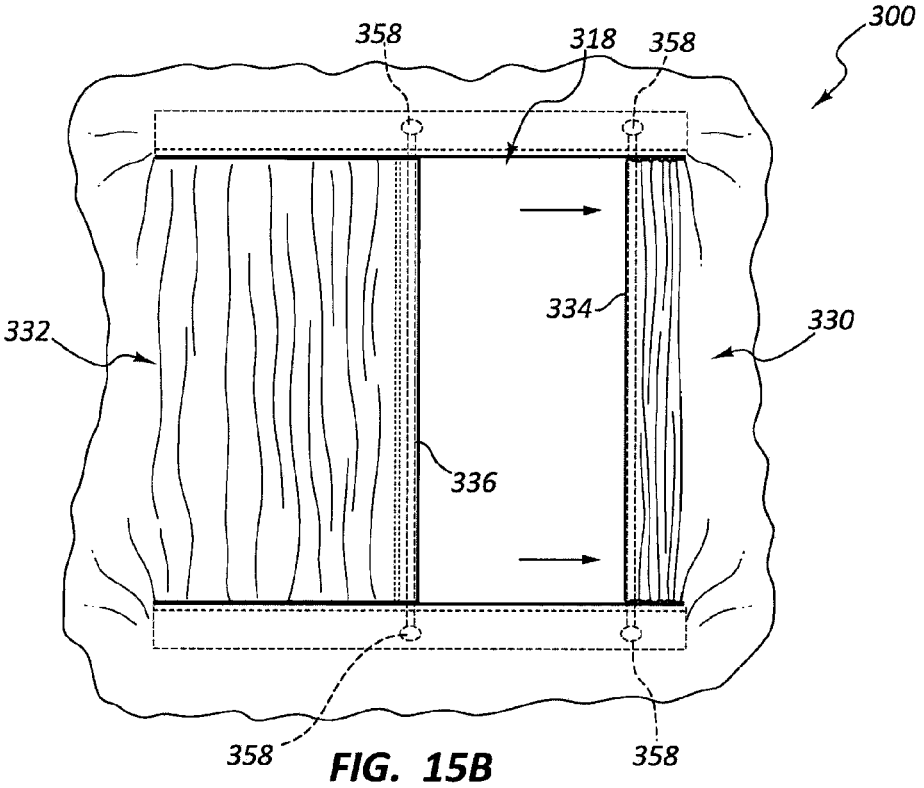
Figure 15C:
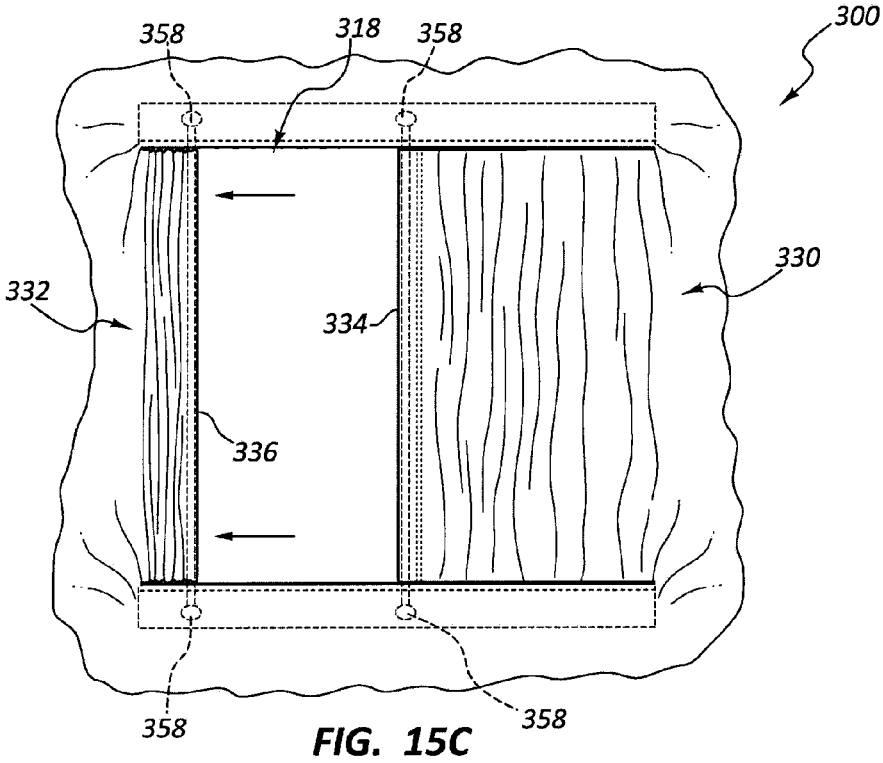
Figure 15D:
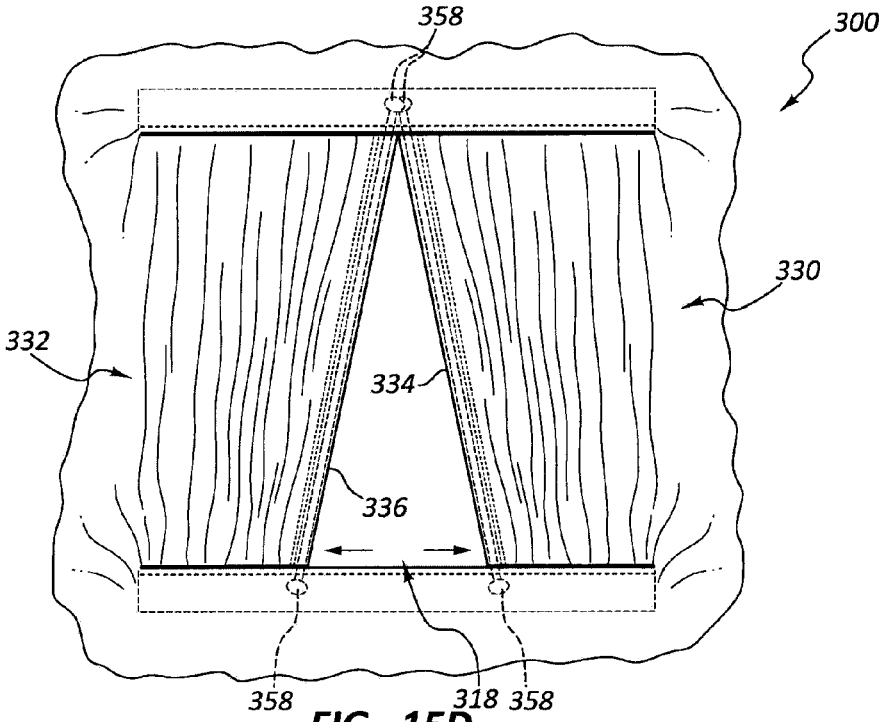
Figure 15E:
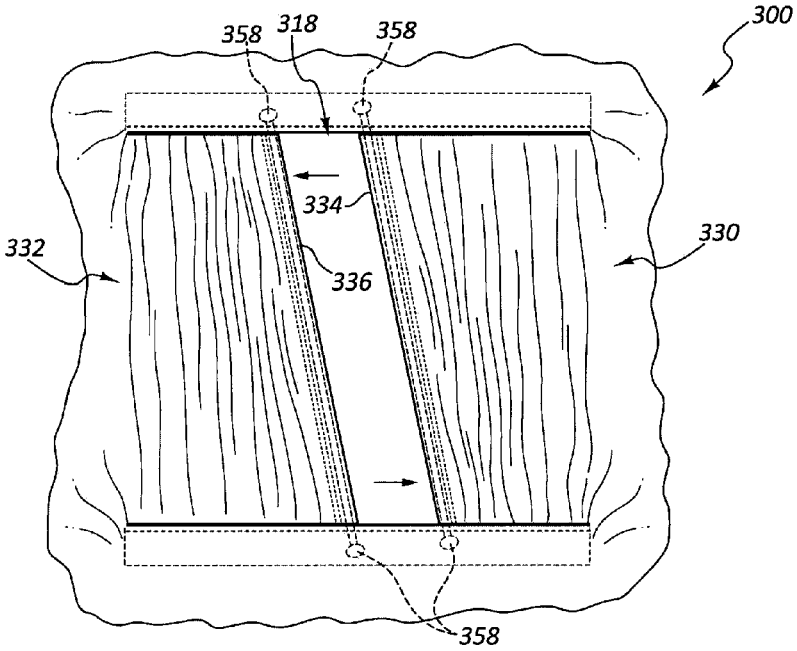

FIG. 12 shows the window panel 230 with an opening edge flap 235 and a side edge flap 239. The opening edge flap 235 may help cover or overlap a gap between the panel opening edge 234 and an opening edge of the cover 14. The side edge flap 239 may cover a portion of the follower track 250 and may help cover a gap or space between the panel side edge 138 and the follower track 250. The side edge flap 239 may at least partially cover the follower track 250.

Referring now to FIGS. 13-16, another example collapsible ground blind 300 is shown including a support structure 12, a cover 14, and a window adjustment system 316. The window adjustment system 316 includes at least one window panel adjustable primarily in a lateral direction as opposed to the generally vertical adjustment direction of the window adjustment systems 10, 100 described above.

The window adjustment system 316 includes first and second window panels 330, 332 that define first and second panel opening edges 334, 336. Each of the first and second window panels 330, 332 include opposing panel side edges 338, 340 and carry first and second followers 346, 348, respectively. The first and second window panels 330, 332 may also include follower sleeves 342, 344, respectively, sized to receive the first and second followers 346, 348, respectively.

The first and second window panels 330, 332 may include surplus material 331, 333, respectively, that permits adjustment of the first and second window panels 330, 332 into different positions and orientations. The first and second window panels 330, 332 may include at least one gathering member 328 (see FIG. 14) that provides at least some gathering function for the surplus material 331, 333. The gathering members 328 may automatically apply at least some tension in the first and second window panels 330, 332 that limit flapping, hanging, or other undesired movement of the surplus material 331, 333. In one example, the gathering members 328 include at least one length of elastic material.

The first and second followers 346, 348 may each have first and second end portions 354, 356 arranged extending into the first and second follower tracks 350, 352, respectively. The first and second followers 346, 348 may include friction members 358 that help retain the first and second end portions 354, 356 within the first and second follower tracks 350, 352. The friction members 358 may also assist in automatically holding the first and second followers 346, 348 in an adjusted position within the first and second follower tracks 350, 352.

The first and second follower tracks 350, 352 may each include a track opening 360 defined by first and second track edges 362, 364. At least one tension member 366 may be positioned along at least one of the first and second track edges 362, 364 to help apply a retention force to the first and second followers 346, 348 to maintain an adjusted position of the first and second followers 346, 348.

A window opening 318 defined by the window adjustment system 316 may be adjusted into various positions and orientations as shown in FIGS. 15A-E. The positions and orientations shown in FIGS. 15A-E may be similar to those shown in FIGS. 3A-F and described above, with the window adjustment system 316 rotated about 90 degrees as compared to the orientation of window adjustment system 16.

Figure 16:
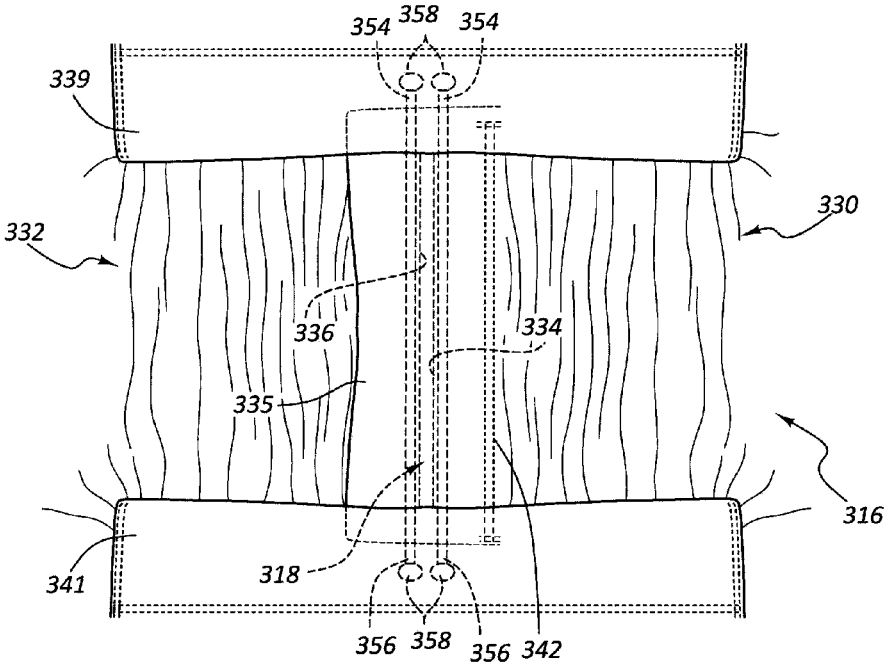
FIG. 16 shows a modified version of the window adjustment system of FIG. 13.

FIG. 16 shows the first and second window panels 330, 332 including an opening edge flap 335, and first and second side edge flaps 339, 341. The opening edge flaps 335, 337 and side edge flaps 339, 341 may be used to overlap or cover gaps and features of the window adjustment system 316 similar to those flaps described above with reference to the other embodiments disclosed herein.

Other window adjustment system embodiments are possible including, for example, a window adjustment system with a lateral or horizontal adjustment configuration similar to that shown in FIGS. 13-16, and that includes only a single window panel. The window adjustment systems disclosed herein may be mounted around a perimeter edge of an opening pre-formed in the cover 14. In other arrangements, the window adjustment system has a size that is greater than that of a pre-formed opening in the cover and is attached to the cover at a location spaced away from a peripheral edge of the opening into the cover 14.

The followers disclosed herein may comprise a generally rigid construction that assists in applying a force that exceeds a threshold force to move the first and second end portions of the follower within the first and second follower tracks. In some arrangements, the followers have some flexibility that permits bending along a length of the follower or some distortion of the follower that influences movement of the first or second end portions of the follower within the first and second follower tracks. In some arrangements, the followers are permanently attached to the window panels. In other arrangements, the followers may be releasably attached to the window panels so as to be replaceable. Replacement of the followers may be for maintenance or for a change in performance of the window adjustment system.

Figure 17:
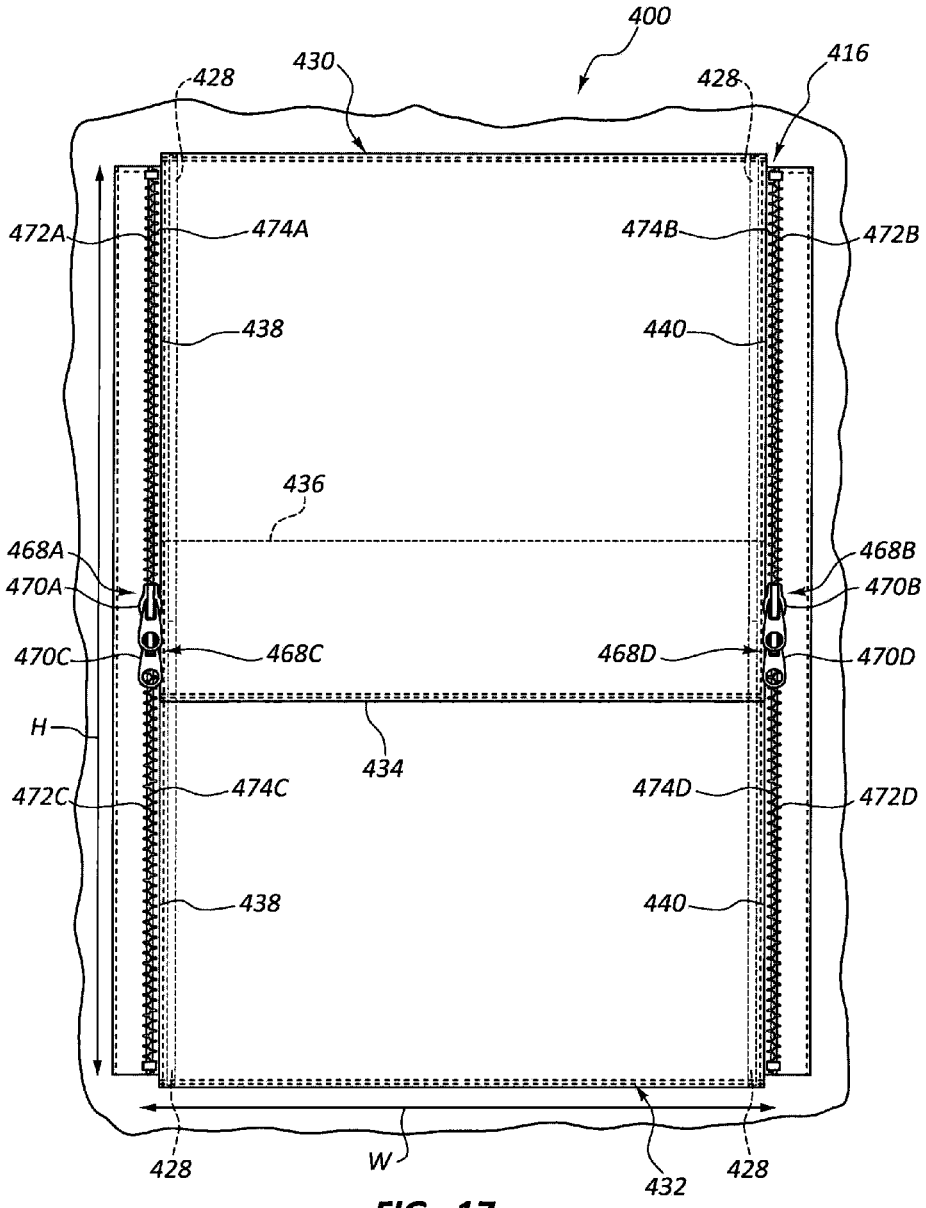
FIG. 17 shows another example window adjustment system implementing a plurality of zipper adjustment members in accordance with the present disclosure.
Figure 18A:
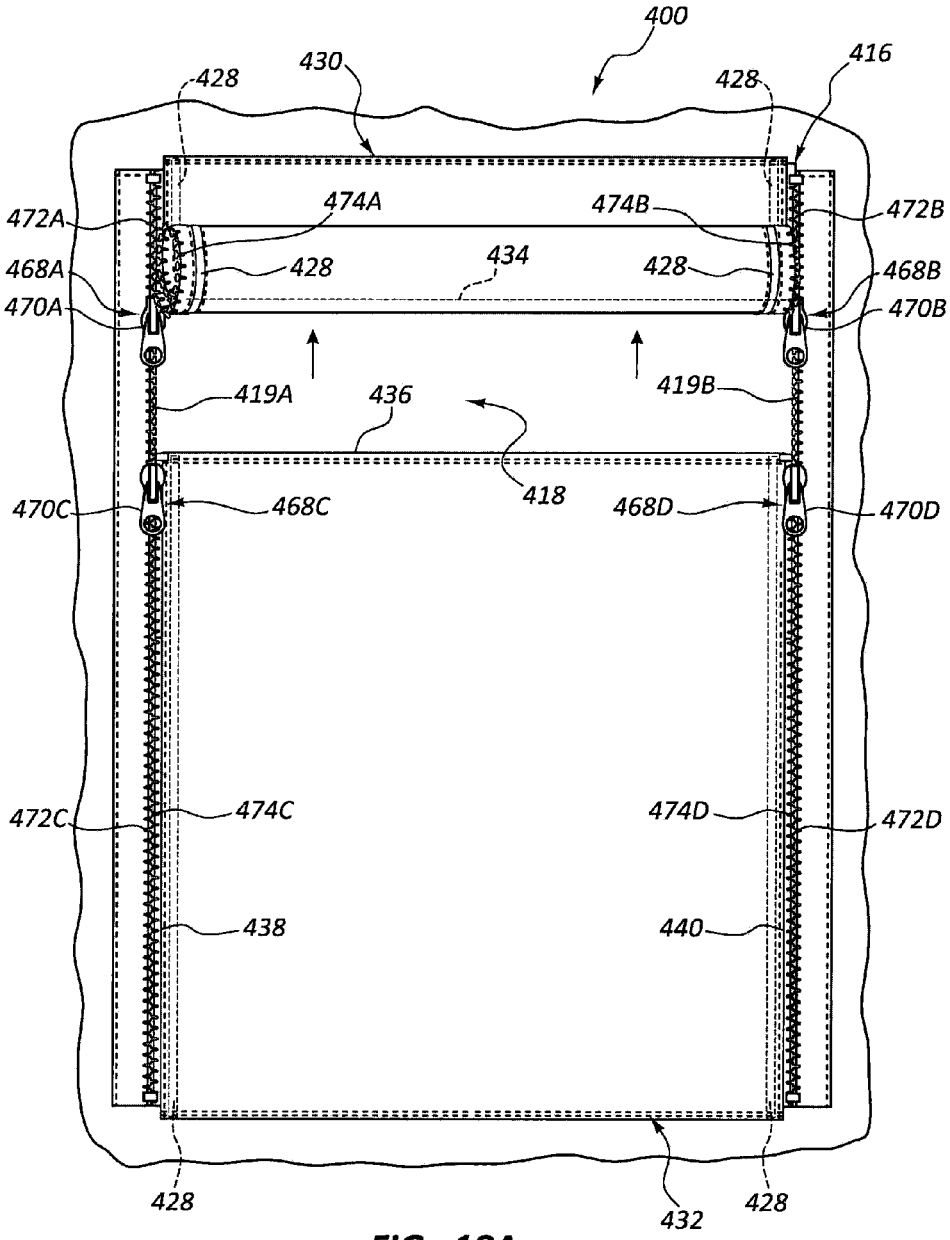
FIGS. 18A-D show different adjusted positions of the window adjustment system of FIG. 17.
Figure 18B:
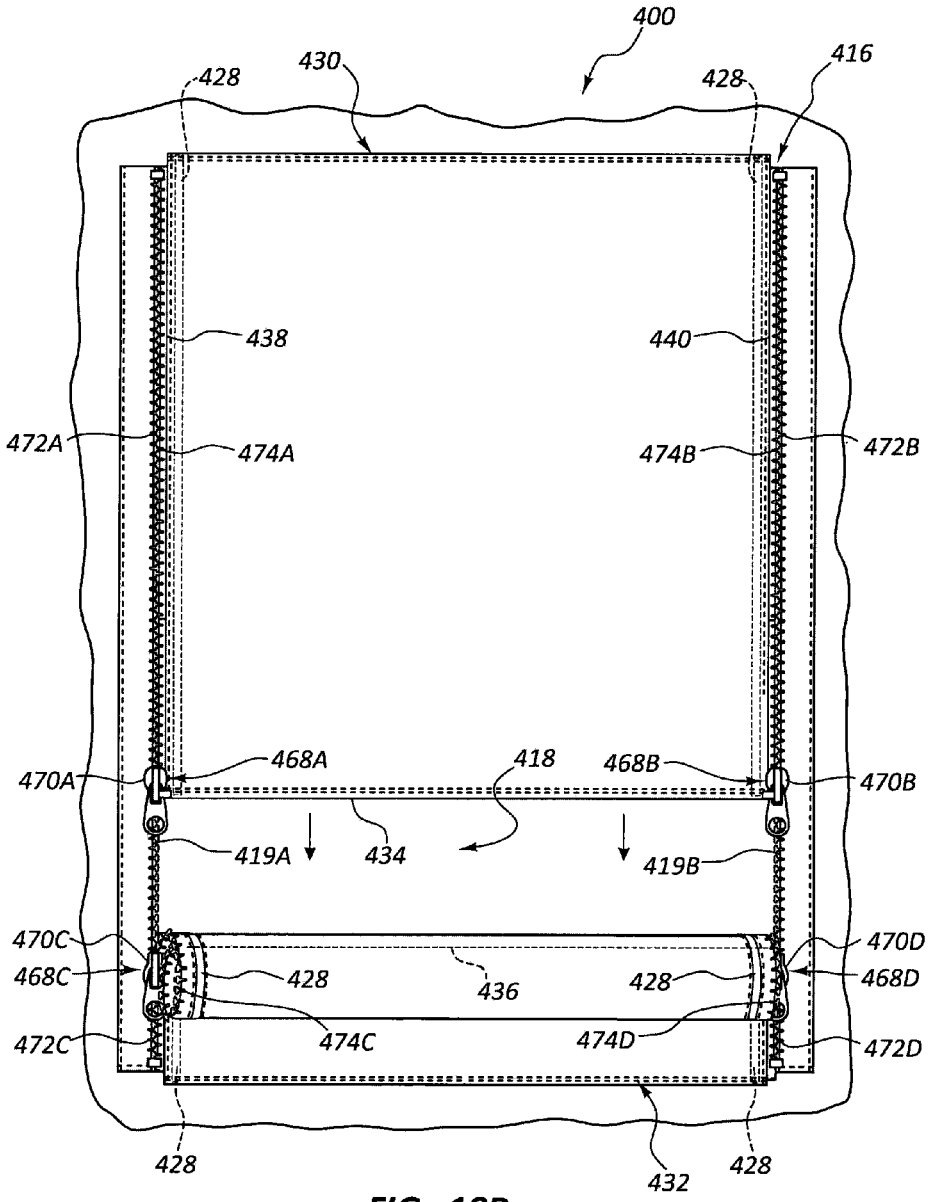
Figure 18C:
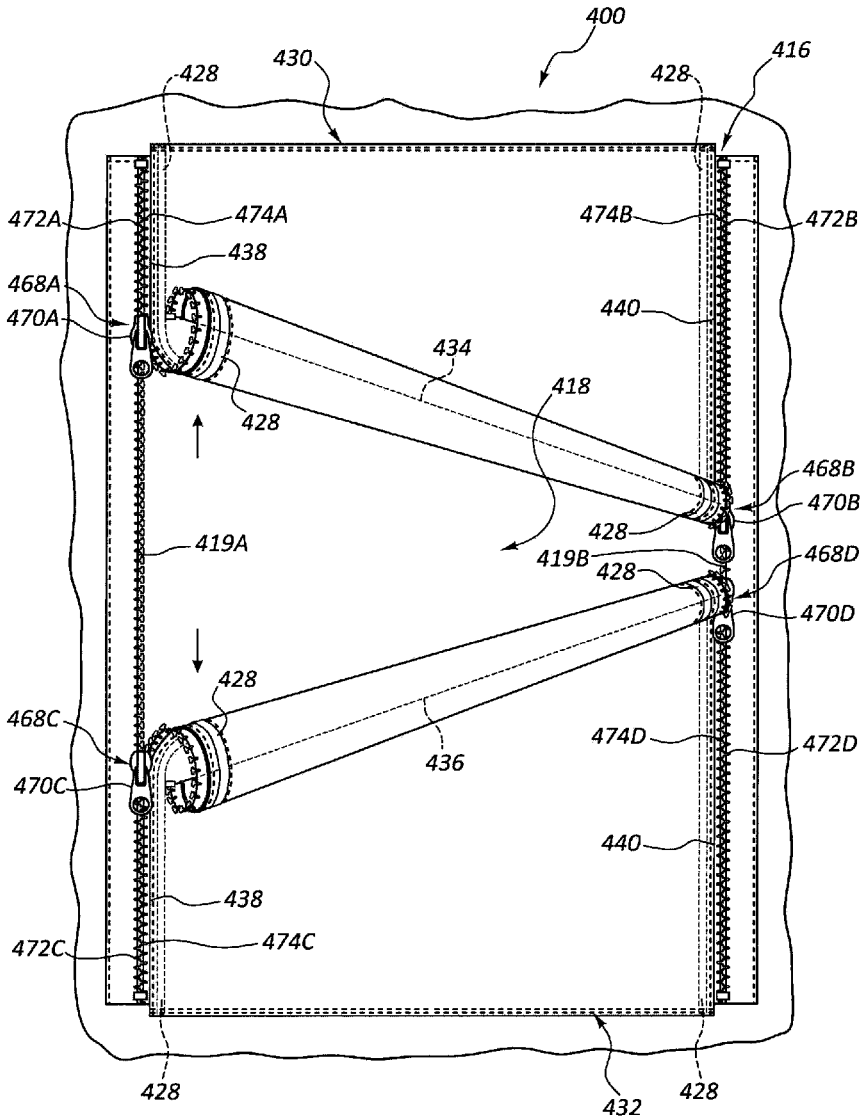
Figure 18D:
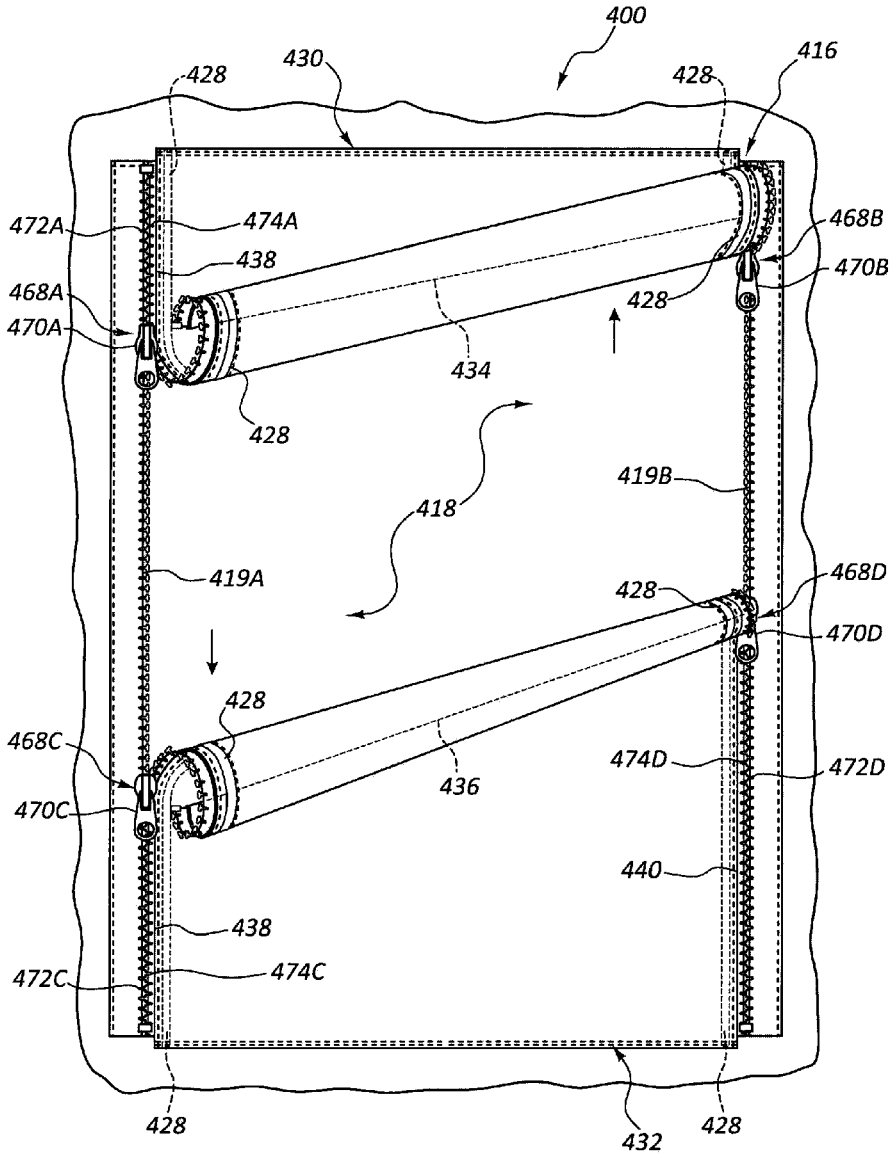

Referring to FIGS. 17-18D, another window adjustment system 416 is shown mounted to a blind 400 (e.g., a side panel of a ground blind). The window adjustment system 416 may include first and second window panels 430, 432, first and second panel opening edges 434, 436 positioned on the first and second window panels 430, 432, respectively, and opposing panel side edges 438, 440 on each of the first and second window panels 430, 432.

The first and second window panels 430, 432 may each include at least one biasing member 428 (also referred to herein as an elastic member) that provides at least some gathering or tensioning in a portion of the first and second window panels 430, 432 that is otherwise free or loose. The gathering members 428 may automatically apply at least some tension in the first and second window panels 430, 432 that limits flapping, hanging, or other undesired movement of a free or loose portion of the first and second window panels 430, 432. In one example, the gathering member 428 includes an elastic material. The elastic material may be connected to the first and second window panels 430, 432 using, for example, sewing or adhesives. A plurality of gathering members 428 may be positioned at spaced apart locations across a width of the first and second window panels 430, 432 between the side edges 438, 440. In one example, a gathering member 428 is positioned along each of the side edges 438, 440.

The window adjustment system 416 may also include a plurality of window adjustment members 468A-D that each include an actuator 470A-D, and first and second track portions 472A-D, 474A-D. A separate window adjustment member 468A-D is operable along each of the panel side edges 438, 440 of each of the first and second window panels 430, 432. The window adjustment members 468A-D may be configured as zipper fasteners. The first track portions 472A-D may be positioned along a side edge 419A-B of a window opening 418 that is covered by the window panels 430, 432 (see FIG. 18A). The second track portions 474A-D may be positioned along the side edges 438, 440 of the window panels 430, 432. In some arrangements, the second track portions 472A,C are aligned and may define a continuous track along which the actuators 470A,C operate, and the second track portions 472B,D are aligned and may define a continuous track along which the actuators 470B,D operate. In embodiments where the adjustment members 468A-D have continuous track portions, the first panel opening edge 434 may be adjusted to a position lower than a highest possible position for the second panel opening edge 436.

Each of the window adjustment members 468A-D may be independently adjustable to alter, at least in part, a size, shape or orientation of the window opening 418. FIGS. 17 and 18A-D show several different configurations for the window opening 418 that are possible by independently adjusting the window adjustment members 468A-D. The window adjustment system 416 may be adjusted to move the window opening 418 from a closed position (see FIG. 17) to an open position (see any of FIGS. 18A-D). A position (e.g., height) of the window opening 418 may be moved up or down relative to a structure to which the window adjustment system 416 is mounted (e.g., cover 14 of ground blind 10 shown in FIG. 1).

The window adjustment system 416 shown in FIGS. 17-18D includes window panels 430, 432 arranged vertically relative to each other. One arrangement for the window adjustment system 416 provides the first and second panel opening edges 434, 436 arranged horizontally and movable generally vertically relative to each other. Other embodiments include window panels that are arranged horizontally with opening edges that move horizontally relative to each other (e.g., see the embodiment of FIGS. 13-16) or diagonally relative to each other. The window adjustment members 468A-D may be used with any window construction having at least one window panel, and more preferably at least two window panels, wherein each window panel has opposing side edges with a separate biasing member associated with each side edge.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive, and that reference be made to the appended claims and their equivalents for determining the scope of the instant disclosure. In addition, for ease of use, the words "including" and "having," as used in the specification and claims, are interchangeable with and have the same meaning as the word "comprising."

What is claimed is:

1. A portable ground blind, comprising:

a collapsible support structure;

a flexible cover mounted to the collapsible support structure and having a camouflage pattern along at least an exterior surface thereof, the support structure and cover defining a ground blind interior sized to accommodate at least one sportsman;

a window assembly defining a selectably openable window opening in the cover, the window opening being configured to permit the at least one sportsman to shoot wild game from within the ground blind interior, the window assembly comprising:

at least one flexible window panel having a plurality of edges;

at least one zipper operable along at least one of the side edges to selectively connect and disconnect the at least one side edge relative to the cover to alter a size of the window opening;

at least one gathering member positioned on the at least one flexible window panel and configured to automatically apply at least some tension in the at least one flexible window panel that limits undesired movement of a loose portion of the at least one flexible window panel when the at least one side edge is disconnected from the cover, and wherein the tension gathers the at least one flexible window panel relative to the at least one flexible window panel itself.

2. The ground blind of claim 1, wherein the at least one zipper is operable along an entire length of the at least one side edge.

3. The ground blind of claim 1, wherein the plurality of side edges include opposed side edges, and the at least one zipper includes separate zippers operable along each of the opposed side edges.

4. The ground blind of claim 1, wherein the at least one gathering member includes an elastic member.

5. The ground blind of claim 4, wherein the elastic member extends parallel to at least one of the plurality of side edges.

6. The ground blind of claim 1, wherein the at least one gathering member applies a tension force in the at least one flexible window panel.

7. The ground blind of claim 1, wherein the plurality of side edges are arranged vertically.

8. The ground blind of claim 1, wherein the at least one flexible window panel includes first and second window panels, the first and second window panels each having portions coupled to the cover vertically in series relative to each other.

9. The ground blind of claim 1, wherein the at least one gathering member includes a plurality of elastic members positioned at spaced apart locations across a width of the at least one flexible window panel.

10. The ground blind of claim 1, wherein at least two of the plurality of side edges are arranged parallel to each other.

11. A portable ground blind, comprising:

a collapsible support structure;

a flexible cover mounted to the collapsible support structure, the support structure and cover defining sidewalls, a ceiling, and an interior sized to accommodate at least one sportsman;

a window assembly, comprising:

a window opening formed in the cover and configured to permit the at least one sportsman to view wild game from within the interior;

at least one flexible window panel positioned in the window opening and having a plurality of side edges;

separate zippers operable along at least two of the side edges to selectively connect and disconnect the respective side edges relative to the cover to adjust a size of an exposed portion of the window opening;

at least one elastic member positioned on the at least one flexible window panel and configured to automatically gather the at least one flexible window panel when one of the side edges is disconnected relative to the cover.

12. The ground blind of claim 11, wherein the window opening is positioned at a height of the sportsman's eyes when sitting.

13. The ground blind of claim 11, wherein the window opening is configured to permit the sportsman to shoot wild game from within the interior.

14. The ground blind of claim 11, wherein the at least one elastic member includes a plurality of elastic members.

15. The ground blind of claim 11, wherein the at least one elastic member extends parallel to the side edges.

16. The ground blind of claim 11, wherein the at least one flexible window panel includes first and second window panels, the first and second window panels each having portions coupled to the cover vertically in series relative to each other.

17. A portable ground blind, comprising:

a collapsible support structure;

a flexible cover mounted to the collapsible support structure, the support structure and cover defining a ground blind interior sized to accommodate at least one sportsman;

a window assembly, comprising:

a window opening formed in the cover and configured to permit the at least one sportsman to view wild game from within the interior;

first and second flexible window panels each having at least one side edge;

a separate zipper operable along at least one of the side edges of each of the first and second flexible window panels to selectively connect and disconnect the side edges relative to the cover;

at least one elastic member positioned on each of the first and second flexible window panels and configured to automatically gather the respective window panel when one of the side edges is disconnected relative to the cover.

18. The ground blind of claim 17, wherein the at least one elastic member includes separate elastic members positioned on each of the window panels to apply tension in the window panels.

19. The ground blind of claim 17, wherein the window assembly includes four zippers.

20. The ground blind of claim 17, wherein the ground blind is sized for carrying by a single person.

* * * * *